US011466580B2

(12) United States Patent
Underwood et al.

(10) Patent No.: US 11,466,580 B2
(45) Date of Patent: Oct. 11, 2022

(54) CMC NOZZLE WITH INTERLOCKING MECHANICAL JOINT AND FABRICATION

(71) Applicant: General Electric Company, Schenectady, NY (US)

(72) Inventors: Sara Saxton Underwood, Schenectady, NY (US); Douglas Glenn Decesare, Queensbury, NY (US); Michael Ray Tuertscher, Fairfield, OH (US); Daniel Gene Dunn, Guilderland, NY (US); Douglas Melton Carper, Trenton, OH (US)

(73) Assignee: General Electric Company, Schenectady, NY (US)

( * ) Notice: Subject to any disclaimer, the term of this patent is extended or adjusted under 35 U.S.C. 154(b) by 1300 days.

(21) Appl. No.: 15/969,435

(22) Filed: May 2, 2018

(65) Prior Publication Data

US 2019/0338660 A1 Nov. 7, 2019

(51) Int. Cl.
*F01D 9/04* (2006.01)
*F01D 25/12* (2006.01)

(52) U.S. Cl.
CPC ..... *F01D 9/042* (2013.01); *F01D 25/12* (2013.01); *F05D 2220/32* (2013.01); *F05D 2220/3212* (2013.01); *F05D 2230/60* (2013.01); *F05D 2240/12* (2013.01); *F05D 2260/20* (2013.01); *F05D 2300/2261* (2013.01); *F05D 2300/5023* (2013.01)

(58) Field of Classification Search
CPC ..... F01D 9/042; F01D 25/12; F05D 2220/32; F05D 2220/3212; F05D 2300/60; F05D 2240/12; F05D 2260/20; F05D 2300/2261; F05D 2300/5023
See application file for complete search history.

(56) References Cited

U.S. PATENT DOCUMENTS 5,506,018 A 4/1996 Jacob et al.
5,862,975 A 1/1999 Childress
(Continued)

FOREIGN PATENT DOCUMENTS

EP 1905956 A2 4/2008
EP 2412928 A1 2/2012
(Continued)

OTHER PUBLICATIONS

Brun, Milivoj K., Formation of Tough Composite Joints, Journal of the American Ceramic Society, Dec. 1998, vol. 81, No. 12, pp. 3307-3312.

(Continued)

*Primary Examiner* — Topaz L. Elliott
*Assistant Examiner* — Aye S Htay
(74) *Attorney, Agent, or Firm* — Dority & Manning, P.A.

(57) ABSTRACT

A nozzle including a vane and a band, each having defined therein interlocking features. The vane and the band are each formed of a ceramic matrix composite (CMC) including reinforcing fibers embedded in a matrix. The vane and the band include one or more interlocking features. The nozzle further including an interlocking mechanical joint joining the vane and the band to one another. Methods are also provided for joining the vane and the band at the interlocking features to form an interlocking mechanical joint.

21 Claims, 16 Drawing Sheets

(56) References Cited

U.S. PATENT DOCUMENTS

| | | | | |
|---|---|---|---|---|
| 6,648,597 | B1 * | 11/2003 | Widrig | C04B 37/001 415/200 |
| 7,229,513 | B2 | 6/2007 | Keith et al. | |
| 7,329,087 | B2 | 2/2008 | Cairo et al. | |
| 7,802,799 | B1 | 9/2010 | Semmes | |
| 7,963,038 | B2 | 6/2011 | Schmitz | |
| 8,961,059 | B2 | 2/2015 | Reeves et al. | |
| 9,102,103 | B2 | 8/2015 | Fox et al. | |
| 9,114,588 | B2 | 8/2015 | Oefner | |
| 9,132,619 | B2 | 9/2015 | Khalifa et al. | |
| 9,149,997 | B2 | 10/2015 | Foster et al. | |
| 9,151,166 | B2 | 10/2015 | Uskert | |
| 9,291,060 | B2 | 3/2016 | Lazur | |
| 9,327,446 | B2 | 5/2016 | Clark et al. | |
| 9,511,446 | B2 | 12/2016 | Kandasamy et al. | |
| 9,555,587 | B2 | 1/2017 | Konez | |
| 9,803,486 | B2 * | 10/2017 | Freeman | F01D 5/288 |
| 11,041,394 | B2 * | 6/2021 | Walston | F01D 5/284 |
| 2005/0254942 | A1 * | 11/2005 | Morrison | C04B 37/005 415/200 |
| 2009/0324393 | A1 | 12/2009 | Gonzalez et al. | |
| 2012/0301317 | A1 * | 11/2012 | Alvanos | F01D 25/246 416/241 B |
| 2015/0345296 | A1 | 12/2015 | Davidson et al. | |
| 2015/0345307 | A1 | 12/2015 | Davidson et al. | |
| 2015/0345314 | A1 | 12/2015 | Davidson et al. | |
| 2016/0003094 | A1 | 1/2016 | Renggli et al. | |
| 2016/0046084 | A1 | 2/2016 | Konez | |
| 2016/0169033 | A1 * | 6/2016 | Weaver | F01D 25/005 415/200 |
| 2016/0290146 | A1 | 10/2016 | Brandl | |
| 2016/0325368 | A1 | 11/2016 | Landwehr et al. | |
| 2016/0376893 | A1 | 12/2016 | Hardwicke et al. | |
| 2017/0100909 | A1 | 4/2017 | Georgeson et al. | |
| 2017/0107836 | A1 | 4/2017 | Roberts et al. | |
| 2019/0063246 | A1 * | 2/2019 | Frey | C04B 35/80 |

FOREIGN PATENT DOCUMENTS

| | | | |
|---|---|---|---|
| EP | 2412929 | A1 | 2/2012 |
| EP | 3054096 | A1 | 8/2016 |
| WO | 2014137457 | A1 | 9/2014 |

OTHER PUBLICATIONS

Corman, G. S., & Luthra, K. L., Melt Infiltrated Ceramic Composites (HiperComp) For Gas Turbine Engine Applications, Jan. 2006, Continuous Fiber Ceramic Composites Program Phase II Final Report for the Period May 1994-Sep. 2005, Chapter 3.3 Composite Joining, pp. 97-115.

Dunn, D. et al., "CMC Component and Fabrication Using Mechanical Joints", U.S. Appl. No. 15/810,874, filed Nov. 13, 2017, pp. 1-44.

Hock, M. et al., "CMC Shroud Segment With Interlocking Mechanical Joints and Fabrication", U.S. Appl. No. 15/920,741, filed Mar. 14, 2018, pp. 1-56.

European Patent Office, Extended European Search Report issued in corresponding EP Application No. 19172092.9, dated Sep. 6, 2019, 9 pages.

* cited by examiner

CMC NOZZLE WITH INTERLOCKING MECHANICAL JOINT AND FABRICATION

BACKGROUND

The subject matter disclosed herein relates to ceramic matrix composite (CMC) subcomponents and the joining of such subcomponents. More particularly, this invention is directed to a CMC nozzle and method of forming the CMC nozzle from multiple subcomponents utilizing one or more interlocking mechanical joints.

Gas turbine engines feature several components. Air enters the engine and passes through a compressor. The compressed air is routed through one or more combustors. Within a combustor are one or more nozzles that serve to introduce fuel into a stream of air passing through the combustor. The resulting fuel-air mixture is ignited in the combustor by igniters to generate hot, pressurized combustion gases in the range of about 1100° C. to 2000° C. This high energy airflow exiting the combustor is redirected by the first stage turbine nozzle to downstream high and low pressure turbine stages. The turbine section of the gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding the high energy airflow produced by combustion of fuel-air mixture. Gas turbine buckets or blades generally have an airfoil shape designed to convert the thermal and kinetic energy of the flow path gases into mechanical rotation of the rotor. In these stages, the expanded hot gases exert forces upon turbine blades, thus providing additional rotational energy to, for example, drive a power-producing generator.

In advanced gas path (AGP) heat transfer design for gas turbine engines, the high temperature capability of CMCs make it an attractive material from which to fabricate arcuate components such as turbine blades, nozzles and shrouds. Within a turbine engine, a nozzle stage is comprised of a plurality of vanes, also referred to as blades or airfoils, with each vane, or a plurality of vanes, joined to a plurality of bands, also referred to as platforms.

A number of techniques have been used to manufacture turbine engine components such as the turbine blades, nozzles or shrouds using CMCs. CMC materials generally comprise a ceramic fiber reinforcement material embedded in a ceramic matrix material. The reinforcement material serves as the load-bearing constituent of the CMC in the event of a matrix crack; the ceramic matrix protects the reinforcement material, maintains the orientation of its fibers, and carries load in the absence of matrix cracks. Of particular interest to high-temperature applications, such as in a gas turbine engine, are silicon-based composites. Silicon carbide (SiC)-based CMC materials have been proposed as materials for certain components of gas turbine engines, such as the turbine blades, vanes, combustor liners, nozzles and shrouds. SiC fibers have been used as a reinforcement material for a variety of ceramic matrix materials, including SiC, C, and $Al_2O_3$. Various methods are known for fabricating SiC-based CMC components, including Silicomp, melt infiltration (MI), chemical vapor infiltration (CVI), and polymer infiltration and pyrolysis (PIP). In addition to non-oxide based CMCs such as SiC, there are oxide based CMCs. Though these fabrication techniques significantly differ from each other, each involves the fabrication and densification of a preform to produce a part through a process that includes the application of heat and/or pressure at various processing stages. In many instances, fabrication of complex composite components, such as fabrication of CMC gas turbine nozzles, involves forming fibers over small radii which may lead to challenges in manufacturability. More complex geometries may require complex tooling, complex compaction, etc. As a result, two or more simpler shaped components may be manufactured and joined into a more complex shape. This approach reduces manufacturing complexities.

Thus, of particular interest in the field of CMCs is the joining of one CMC subcomponent, or preform, to another CMC or ceramic subcomponent to form a complete component structure. For instance, the joining of one CMC subcomponent to another may arise when the shape complexity of an overall complete structure may be too complex to manufacture as a single part, such as with the previously mentioned gas turbine nozzles, and particularly the nozzle vanes and bands. Another instance where joining of one CMC subcomponent to another may arise is when a large complex structure is difficult to lay-up as a single part, and multiple subcomponents are manufactured and joined to form the large complex structure. Current procedures for bonding CMC subcomponents include, but are not limited to, diffusion bonding, reaction forming, melt infiltration, brazing, adhesives, or the like. Of particular concern in these CMC component structures that are formed of conjoined subcomponents is the separation or failure, of the joint that is formed during the joining procedure when under the influence of applied loads.

Thus, an improved interlocking mechanical joint and method of joining one CMC subcomponent of a gas turbine nozzle to another CMC subcomponent or ceramic monolithic subcomponent to form a complete gas turbine nozzle is desired. The resulting interlocking mechanical joint provides strength and toughness to the gas turbine nozzle structure.

BRIEF DESCRIPTION

Various embodiments of the disclosure include a ceramic composite material gas turbine nozzle and fabrication using interlocking mechanical joints. In accordance with one exemplary embodiment, disclosed is a ceramic matrix composite (CMC) component for a gas turbine. The ceramic matrix composite (CMC) component includes a vane comprised of a ceramic matrix composite (CMC) including reinforcing fibers embedded in a matrix; a band comprised of a ceramic matrix composite (CMC) including reinforcing fibers embedded in a matrix and at least one interlocking mechanical joint joining the vane and the band to form the ceramic matrix composite (CMC) component. The band includes an interlocking recess formed therein a surface.

In accordance with another exemplary embodiment, disclosed is a nozzle for a gas turbine. The nozzle includes a vane comprising a cavity wrap extending longitudinally through the vane and extending therefrom at least one end of the vane and defining therein a cavity, a band comprising an opening formed therein and a recess defined in an outer surface and at least one interlocking mechanical joint joining the vane and the band to form the nozzle. The vane is comprised of a ceramic matrix composite (CMC) including reinforcing fibers embedded in a matrix. The band is comprised of a ceramic matrix composite (CMC) including reinforcing fibers embedded in a matrix. The cavity wrap is configured to engage with the opening in the band at the at least one interlocking mechanical joint.

In accordance with yet another exemplary embodiment, disclosed is a method of forming a ceramic matrix composite (CMC) component. The method includes providing a vane comprised of a ceramic matrix composite (CMC) including reinforcing fibers embedded in a matrix, providing a band comprised of a ceramic matrix composite (CMC) including reinforcing fibers embedded in a matrix and mechanically joining the vane to the band at the plurality of interlocking features to form a plurality of interlocking mechanical joint therebetween. Each of the vane and the band include a plurality of interlocking features. One or more of the plurality of interlocking features comprise at least one interlocking joint and a recess formed in the band.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
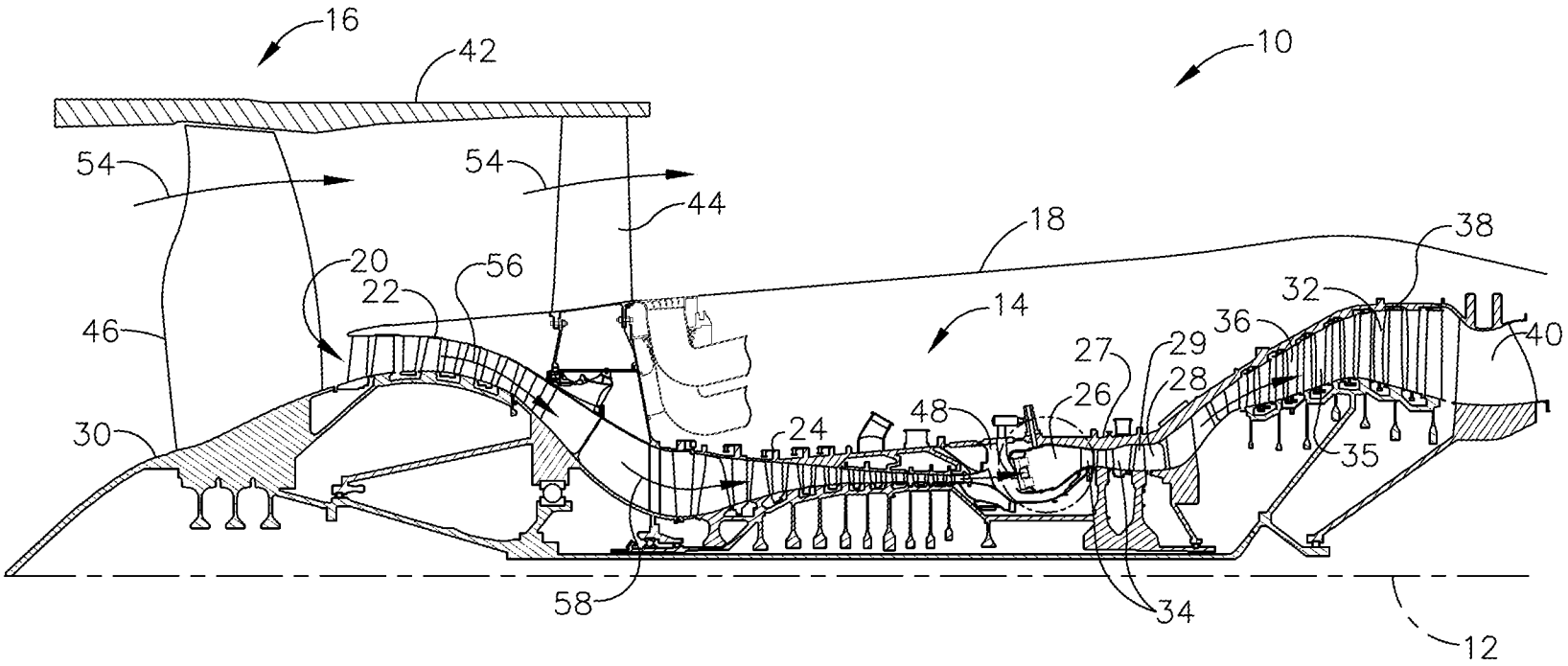
FIG. 1 is a cross sectional illustration of an aviation gas turbine engine, in accordance with one or more embodiments shown or described herein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Approximating language, as used herein throughout the specification and claims, is applied to modify any quantitative representation that could permissibly vary without resulting in a change in the basic function to which it is related. Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by such term is not to be limited to the precise value specified. In at least some instances, the approximating language may correspond to the precision of an instrument for measuring the value. Here and throughout the specification and claims, range limitations are combined and interchanged. Such ranges are identified and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As used herein, ceramic matrix composite or "CMCs" refers to composites comprising a ceramic matrix reinforced by ceramic fibers. Some examples of CMCs acceptable for use herein can include, but are not limited to, materials having a matrix and reinforcing fibers comprising oxides, carbides, nitrides, oxycarbides, oxynitrides and mixtures thereof. Examples of non-oxide materials include, but are not limited to, CMCs with a silicon carbide matrix and silicon carbide fiber (when made by silicon melt infiltration, this matrix will contain residual free silicon); silicon carbide/silicon matrix mixture and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics. Specifically, the oxide-oxide CMCs may be comprised of a matrix and reinforcing fibers comprising oxide-based materials such as aluminum oxide ($Al_2O_3$), silicon dioxide ($SiO_2$), aluminosilicates, and mixtures thereof. Accordingly, as used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, and anisotropic properties as compared to a (non-reinforced) monolithic ceramic structure.

There are several methods that can be used to fabricate SiC—SiC CMCs. In one approach, the matrix is partially formed or densified through melt infiltration (MI) of molten silicon or silicon containing alloy into a CMC preform. In another approach, the matrix is at least partially formed through chemical vapor infiltration (CVI) of silicon carbide into a CMC preform. In a third approach, the matrix is at least partially formed by pyrolizing a silicon carbide yielding pre-ceramic polymer. This method is often referred to as polymer infiltration and pyrolysis (PIP). Combinations of the above three techniques can also be used.

In one example of the MI CMC process, a boron-nitride based coating system is deposited on SiC fiber. The coated fiber is then impregnated with matrix precursor material in order to form prepreg tapes. One method of fabricating the tapes is filament winding. The fiber is drawn through a bath of matrix precursor slurry and the impregnated fiber wound on a drum. The matrix precursor may contain silicon carbide and or carbon particulates as well as organic materials. The impregnated fiber is then cut along the axis of the drum and is removed from the drum to yield a flat prepreg tape where the fibers are nominally running in the same direction. The resulting material is a unidirectional prepreg tape. The prepreg tapes can also be made using continuous prepregging machines or by other means. The tape can then be cut into shapes, layed up, and laminated to produce a preform. The preform is pyrolyzed, or burned out, in order to char any organic material from the matrix precursor and to create porosity. Molten silicon is then infiltrated into the porous preform, where it can react with carbon to form silicon carbide. Ideally, excess free silicon fills any remaining porosity and a dense composite is obtained. The matrix produced in this manner typically contains residual free silicon.

The prepreg MI process generates a material with a two-dimensional fiber architecture by stacking together multiple one-dimensional prepreg plies where the orientation of the fibers is varied between plies. Plies are often identified based on the orientation of the continuous fibers. A zero degree orientation is established, and other plies are designed based on the angle of their fibers with respect to the zero degree direction. Plies in which the fibers run perpendicular to the zero direction are known as 90 degree plies, cross plies, or transverse plies.

The MI approach can also be used with two-dimensional or three-dimensional woven architectures. An example of this approach would be the slurry-cast process, where the fiber is first woven into a three-dimensional preform or into a two-dimensional cloth. In the case of the cloth, layers of cloth are cut to shape and stacked up to create a preform. A chemical vapor infiltration (CVI) technique is used to deposit the interfacial coatings (typically boron nitride based or carbon based) onto the fibers. CVI can also be used to deposit a layer of silicon carbide matrix. The remaining portion of the matrix is formed by casting a matrix precursor slurry into the preform, and then infiltrating with molten silicon.

An alternative to the MI approach is to use the CVI technique to densify the Silicon Carbide matrix in one-dimensional, two-dimensional or three-dimensional architectures. Similarly, PIP can be used to densify the matrix of the composite. CVI and PIP generated matrices can be produced without excess free silicon. Combinations of MI, CVI, and PIP can also be used to densify the matrix.

The joints described herein can be used to join various CMC materials, such as, but not limited to, Oxide-Oxide CMCs or SiC—SiC CMCs, or to join CMCs to monolithic materials. The joints can join subcomponents that are all MI based, that are all CVI based, that are all PIP based, or that are combinations thereof. In the case of interlocking mechanical joints, there may not be direct bonding of the subcomponents together, or the subcomponents may be bonded by silicon, silicon carbide, a combination thereof, or other suitable material. The bonding material may be deposited as a matrix precursor material that is subsequently densified by MI, CVI, or PIP. Alternatively, the bonding material may be produced by MI, CVI, or PIP without the use of matrix precursor in the joint. Furthermore, the joints described herein may be formed at any appropriate stage in CMC processing. That is, the subcomponents may be comprised of green prepreg, laminated preforms, pyrolyzed preforms, fully densified preforms, or combinations thereof.

Referring now to the drawings wherein like numerals correspond to like elements throughout, attention is directed initially to FIG. 1 which depicts in diagrammatic form an exemplary gas turbine engine 10 utilized with aircraft having a longitudinal or axial centerline axis 12 therethrough for reference purposes. It should be understood that the principles described herein are equally applicable to turbofan, turbojet and turboshaft engines, as well as turbine engines used for other vehicles or in stationary applications. In an effort to provide a concise description of these embodiments, not all features of an actual implementation are described in the specification. Furthermore, while a turbine nozzle is used as an example, the principles of the present invention are applicable to any low-ductility flowpath component which is at least partially exposed to a primary combustion gas flowpath of a gas turbine engine and formed of a ceramic matrix composite (CMC) material, and more particularly, any airfoil-platform-like structure, such as, but not limited to, blades, tip-shrouds, or the like.

Engine 10 preferably includes a core gas turbine engine generally identified by numeral 14 and a fan section 16 positioned upstream thereof. Core engine 14 typically includes a generally tubular outer casing 18 that defines an annular inlet 20. Outer casing 18 further encloses a booster compressor 22 for raising the pressure of the air that enters core engine 14 to a first pressure level. A high pressure, multi-stage, axial-flow compressor 24 receives pressurized air from booster 22 and further increases the pressure of the air. The pressurized air flows to a combustor 26, where fuel is injected into the pressurized air stream to raise the temperature and energy level of the pressurized air. The high energy combustion products flow from combustor 26 to a first high pressure (HP) turbine 28 for driving high pressure compressor 24 through a first HP drive shaft, and then to a second low pressure (LP) turbine 32 for driving booster compressor 22 and fan section 16 through a second LP drive shaft that is coaxial with first drive shaft. The HP turbine 28 includes a HP stationary nozzle 34. The LP turbine 32 includes a stationary LP nozzle 35. A rotor disk is located downstream of the nozzles that rotates about the centerline axis 12 of the engine 10 and carries an array of airfoil-shaped turbine blades 36. Shrouds 29, 38, comprising a plurality of arcuate shroud segments, are arranged so as to encircle and closely surround the turbine blades 27, 36 and thereby define the outer radial flowpath boundary for the hot gas stream flowing through the turbine blades 27, 36. After driving each of turbines 28 and 32, the combustion products leave core engine 14 through an exhaust nozzle 40.

Fan section 16 includes a rotatable, axial-flow fan rotor 30 and a plurality of fan rotor blades 46 that are surrounded by an annular fan casing 42. It will be appreciated that fan casing 42 is supported from core engine 14 by a plurality of substantially radially-extending, circumferentially-spaced outlet guide vanes 44. In this way, fan casing 42 encloses fan rotor 30 and the plurality of fan rotor blades 46.

From a flow standpoint, it will be appreciated that an initial air flow, represented by arrow 50, enters gas turbine engine 10 through an inlet 52. Air flow 50 passes through fan blades 46 and splits into a first compressed air flow (represented by arrow 54) that moves through the fan casing 42 and a second compressed air flow (represented by arrow 56) which enters booster compressor 22. The pressure of second compressed air flow 56 is increased and enters high pressure compressor 24, as represented by arrow 58. After mixing with fuel and being combusted in combustor 26, combustion products 48 exit combustor 26 and flow through first turbine 28. Combustion products 48 then flow through second turbine 32 and exit exhaust nozzle 40 to provide thrust for gas turbine engine 10.

Many of the engine components may be fabricated in several pieces, due to complex geometries, and are subsequently joined together. These components may also be directly subjected to hot combustion gases during operation of the engine 10 and thus have very demanding material requirements. Accordingly, many of the components of the engine 10 that are fabricated from ceramic matrix composites (CMCs) may be fabricated in more than one piece and subsequently joined together. Of particular concern herein are the plurality of subcomponents (described presently) that make up the HP turbine nozzle 34 and the joining of the plurality of subcomponents. As previously stated, ceramic matrix composites (CMCs) are an attractive material for turbine applications, because CMCs have high temperature capability and are light weight.

In joining multiple CMC pieces, or subcomponents, such as a plurality of nozzle subcomponents, and more particularly, a plurality of vanes and bands (described presently), to form a complete component structure, such as the nozzle 34, it is desirable to form joints during the component layup process that are damage tolerant and exhibit tough, graceful failure. If the mechanical joint that joins the multiple CMC subcomponents fails, it may result in a catastrophic failure of the component structure.

Of particular concern for these joints is that the bond line tends to be brittle in nature, which could lead to brittle failure of the joint. It has been established in the CMC art that this limitation can be addressed by keeping the stress in the bond low by controlling the surface area of the bond and by making use of simple woodworking type joints such as butt joints, lap joints, tongue and groove joints, mortise and tenon joints, as well as more elaborate sawtooth or stepped tapered joints. Alternatively, joints that contain a mechanical interlock of tough CMC sub-components have also demonstrated graceful failure. Conventional woodworking joints such as dovetail joints have been demonstrated. The above joints can be used to join CMC sub-components in two or three dimensions such as flat plates and "T" shapes. While many woodworking type joints can create a mechanical interlock between two CMC subcomponents, in order for the interlock to take advantage of the full toughness of the CMC, the interlocking feature(s) must be oriented such that the reinforcing fibers would be required to break in order to fail the interlock. If the interlocking feature is oriented such that the joint can be liberated by failing one of the CMC subcomponents in the interlaminar direction, then toughness of the interlock may be limited by the interlaminar properties of the CMC. In general, the interlaminar strength and toughness of CMCs are significantly lower than the in-plane properties.

Figure 2:
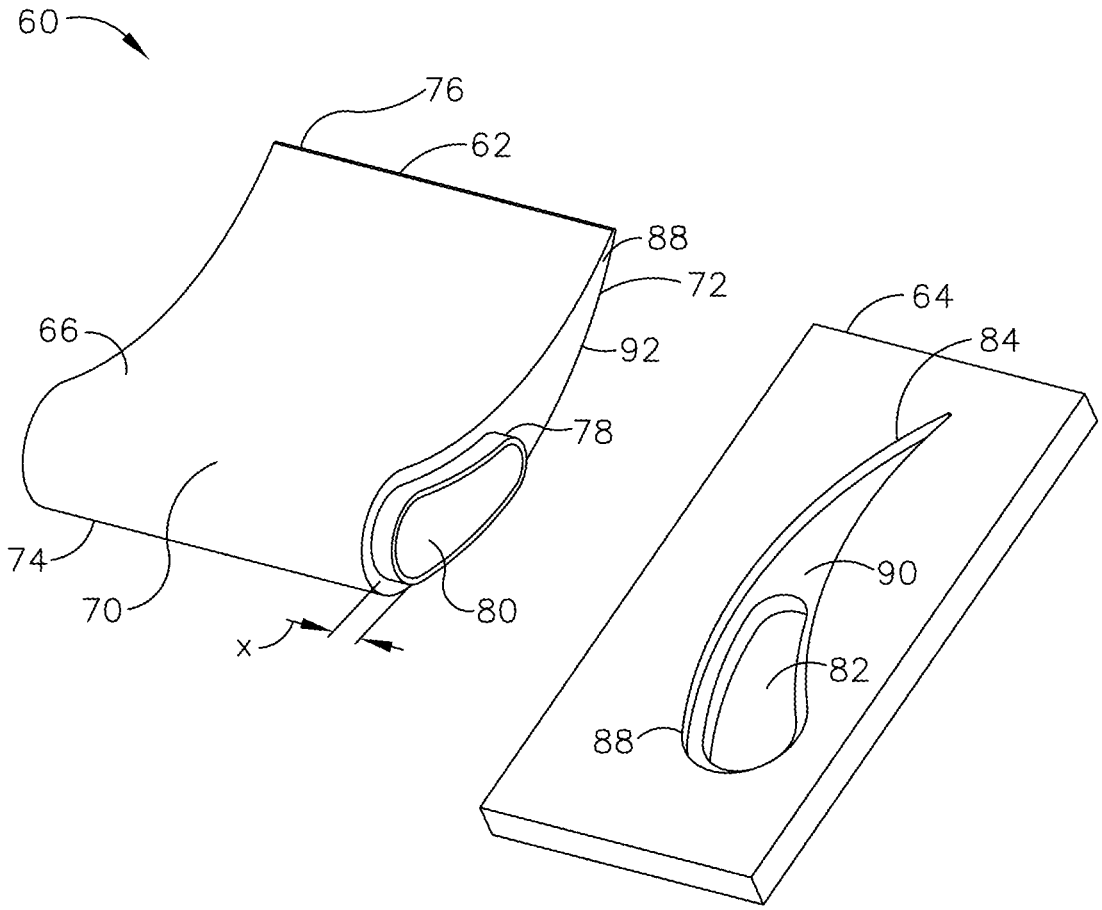
FIG. 2 is a schematic perspective view of a portion of a gas turbine nozzle, and more specifically, a vane and band in an unjoined state, in accordance with one or more embodiments shown or described herein.
Figure 3:
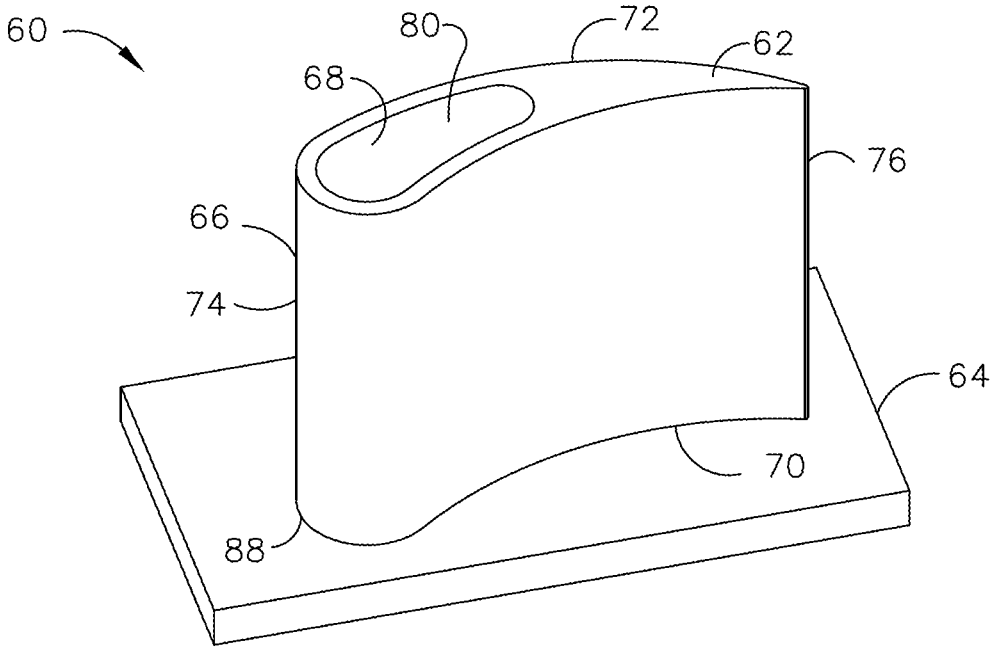
FIG. 3 is a schematic perspective view of a portion of a gas turbine nozzle, and more specifically, a vane and band in a joined state, in accordance with one or more embodiments shown or described herein.
Figure 4:
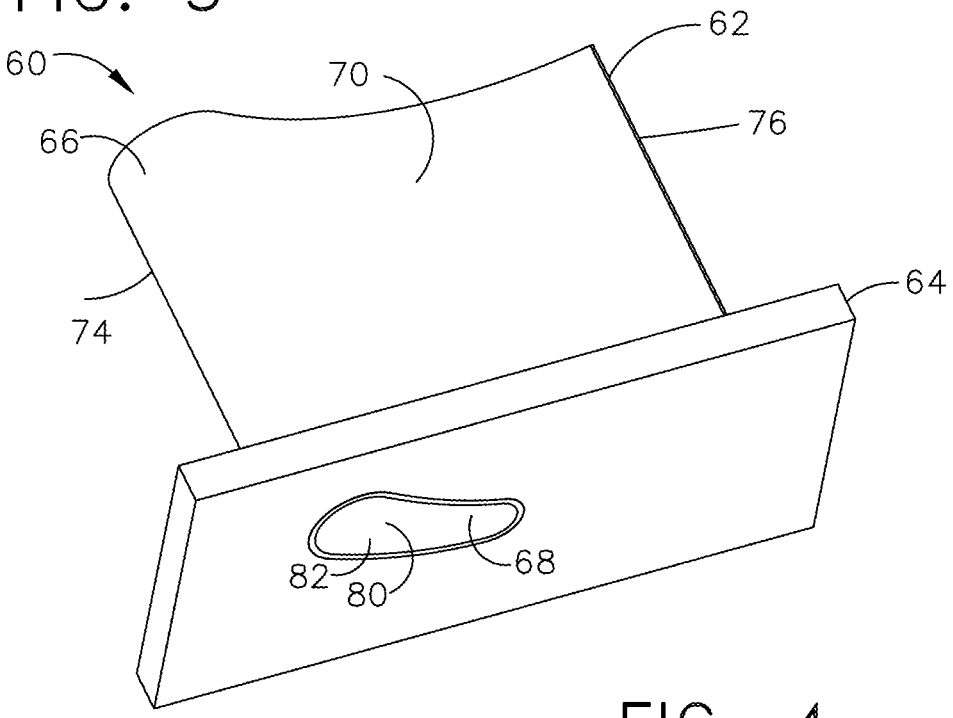
FIG. 4 is a schematic perspective view of a portion of a gas turbine nozzle, and more specifically, a vane and band in a joined state, in accordance with one or more embodiments shown or described herein.

Referring now to FIGS. 2-4, illustrated in an unjoined simplified perspective view and joined simplified perspective views, respectively, is a portion of turbine nozzle 60, such as nozzle 34 of FIG. 1. The nozzle 60 is generally comprised of a plurality of vanes 62, of which only a single vane is shown in FIGS. 2-4, and a plurality of bands 64, of which only a single band is shown in FIGS. 2-4. In exemplary embodiments, each of the plurality of vanes 62 extends between a plurality of bands 64. Each of the plurality of vanes 62 may have a generally aerodynamic contour. For example, as illustrated in FIGS. 2-4, the vane 62 may have an exterior surface 66 and an interior surface 68. In embodiments wherein the vane 62 is an airfoil, the exterior surface 66 may define a pressure side 70 and suction side 72 each extending between a leading edge 74 and a trailing edge 76, or any other suitable aerodynamic contour. Each of the plurality of vanes 62 includes a cavity wrap 78 (FIG. 2) extending at least substantially through the vane 62 and defining therein a cavity 80. As best illustrated in FIG. 2, the cavity wrap 78 is configured to extend a distance "x" from one or more ends of the vane 62 and engages with one or more of the bands 64 to define an interlocking mechanical joint (described presently).

Each of the plurality of bands 64 defines an opening 82 formed therein. The opening 82 may allow a cooling medium (not shown) to flow to into the cavity 80 of the vane 62, defined by the interior surface 68, as is generally known in the art. Each of the plurality of bands 64 further includes a recess 84 defined into an outer surface 86 of the band 64. As best illustrated in FIG. 2, the recess 84 is defined by a substantially vertical sidewall 88 and a surface 90. In an embodiment, the surface 90 is substantially planar. In another embodiment, the surface 90 may include contouring. The recess 84 is configured to engage with at least a portion of an outer perimeter 92 of the vane 62 when the vane 62 and the band 64 are joined together to define an interlocking mechanical joint (described presently).

Referring now to FIGS. 5-23, illustrated are a plurality of embodiments of a nozzle, including a vane 62 joined to a band 64 to form an interlocking mechanical joint 98 as disclosed herein. It should be known that throughout the embodiments, only a portion of the nozzle, and more particularly, a portion of a single vane 62 and single band 64 are illustrated. As illustrated, each figure is depicted having a simplified block geometry and illustrated noting a linear direction of the fibers within the component, as linear fill lines. However, the fibers in individual plies may be oriented in any direction within the plane defined by the fill line as projected in and out of the page. In each of the embodiments disclosed herein, the described interlocking mechanical joints may be used to join the vane 62 and the band 64 to form a larger or complete component structure, such as nozzle 34 of FIG. 1. In alternate embodiments, any of the vane 62, the band 64 and/or additional interlocking subcomponents (described presently) may be comprised as a monolithic ceramic subcomponent.

Figure 5:
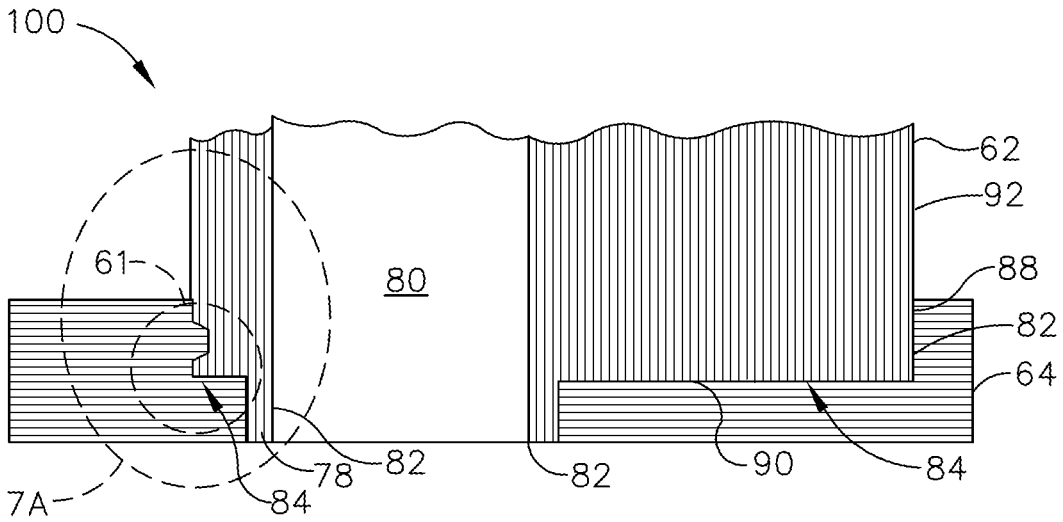
FIG. 5 is a simplified cross-section view illustrating an interlocking mechanical joint for joining a plurality of subcomponents of a nozzle, in accordance with one or more embodiments shown or described herein.
Figure 6:
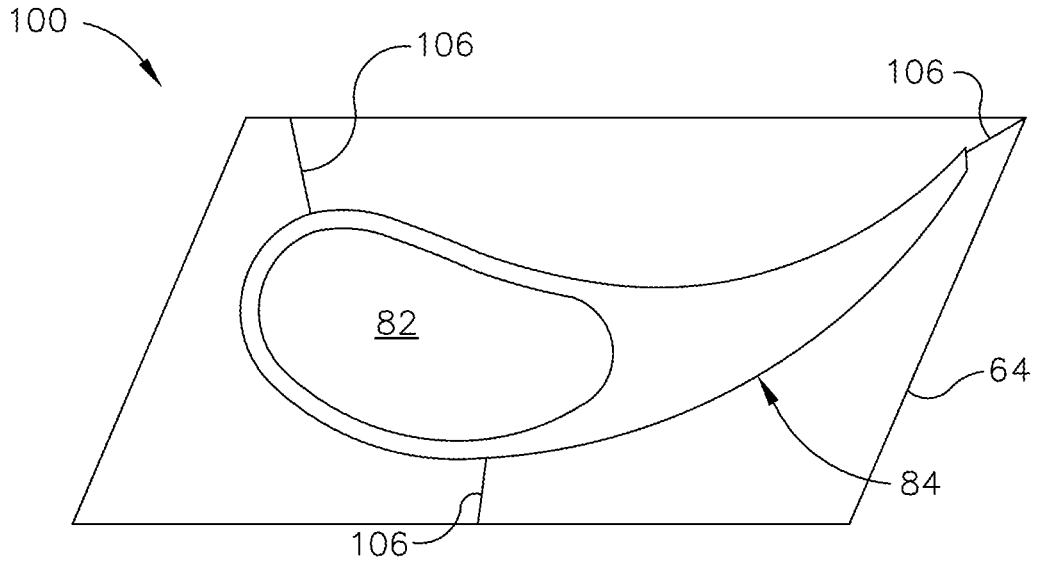
FIG. 6 is a top schematic view of the band subcomponent of FIG. 5, in accordance with one or more embodiments shown or described herein.
Figure 7A:
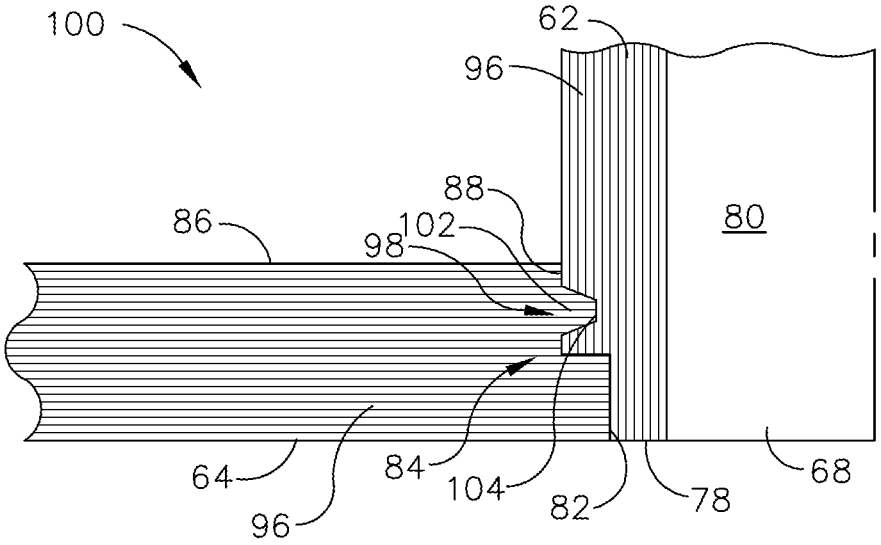
FIG. 7A is a simplified cross-section view illustrating another embodiment of an interlocking mechanical joint for joining a plurality of subcomponents of a nozzle, in accordance with one or more embodiments shown or described herein.
Figure 7B:
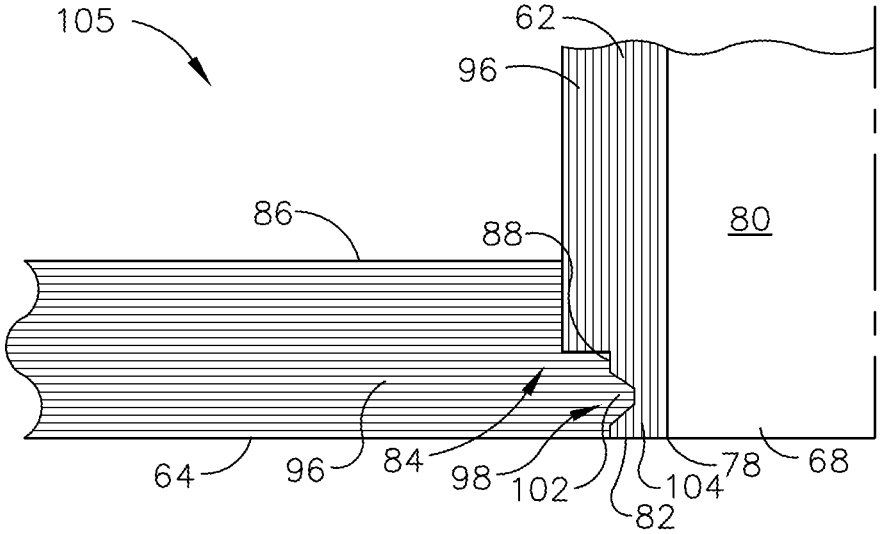
FIG. 7B is a simplified cross-section view illustrating another embodiment of an interlocking mechanical joint for joining a plurality of subcomponents of a nozzle, in accordance with one or more embodiments shown or described herein.

Referring more specifically to FIGS. 5-7B, illustrated are embodiments of a nozzle 100, 105 including an interlocking mechanical joint 98. FIG. 5 illustrates in a simplified sectional view, the nozzle 100 as comprised of a plurality of subcomponents, and namely, a vane 62 coupled to a band 64. FIG. 6 illustrates a simplified top view of the band 64, FIG. 7A illustrates an enlargement of the interlocking mechanical joint 98 of the nozzle 100 and FIG. 7B illustrates an alternate embodiment, and more particularly an interlocking mechanical joint 90 of the nozzle 105. As illustrated, the band 64 includes a recess 84 defined in the surface 86 as described previously with regard to FIG. 2. As best illustrated in FIG. 5, the recess 84 is defined by a sidewall 88 and a generally planar surface 90. As previously described with reference to FIGS. 3 and 4, the vane 62 is positioned proximate the band 64 so as to position the cavity wrap 78 within the opening 82 formed in the band 64 and at least a portion of the outer perimeter 92 of the vane 62 retained within the recess 84.

Referring more particularly to FIG. 7A, illustrated is an enlargement of the interlocking mechanical joint 98, as indicated in FIG. 5. In this particular embodiment, each of the vane 62 and the band 64 include one or more interlocking features (described herein) defining the interlocking mechanical joint 98. In this particular embodiment, the one or more interlocking features include a plurality of geometrically defined interlocking features. Each of the vane 62 and band 64 are configured to cooperatively engage to form the interlocking mechanical joint 98. More particularly, as illustrated in FIG. 7A, the band 64 includes one or more projections 102 extending from the sidewall 88 that forms the recess 84. The vane 62 includes one or more recesses 104 that cooperatively engage with the one or more projections 102 to form the interlocking mechanical joint 98. In the embodiment of FIG. 7A, the vane sidewall includes one or more recesses 104 that cooperatively engage with the one or more projections 102 of the band 64 to form the interlocking mechanical joint 98. In an alternative embodiment, as best illustrated in FIG. 7B, the cavity wrap 78 includes the one or more recesses 104 that cooperatively engage with the one or more projections 102 of the band 64 to form the interlocking mechanical joint 98. As used herein the term "engage" and "sliding engagement" include fixed or non-fixed insertion therein of the interlocking features, relative to one another.

In the embodiments of FIGS. 7A and 7B, the vane 62 and the band 64 are constructed from a ceramic matrix composite (CMC) material of a known type. In particular, the CMC material includes a plurality of reinforcing fibers embedded in a matrix and wherein the plurality of reinforcing fibers are oriented substantially along a length of the component. In an alternate embodiment, one of the vane 62 or the band 64 is formed of a ceramic matrix composite (CMC) material of a known type, while the other of the vane 62 or the band 64 is formed of a monolithic ceramic material. Throughout the embodiments, fill lines represent the orientation/planes of a plurality of fiber plies 96 that comprise the vane 62 and band 64, respectively. Accordingly, the assembled portion of the nozzle 100 may include one or more CMC subcomponents and one or more monolithic ceramic subcomponents, or all subcomponents may be of a ceramic matrix composite (CMC) material.

The one or more recesses 84 in the band 64 provide retainment of the vane 62 relative to the band 64 about at least a portion of the outer perimeter 92 of the vane 62 and improves the performance of the joined components (e.g. reduce leakage and improve torsion capability). As best illustrated in FIG. 6, during assembly of the nozzle 100 or 105, the plies 96 that comprise the band 64 are split, such as along lines 106 to enable positioning of the vane 62 relative to the band 64 and engagement of the cooperative interlocking features 102 and 104 that form the interlocking mechanical joint 98. In an embodiment, the full thickness of plies 96 that comprise the band 64 may be split to accommodate assembly of the nozzle 100 or 105. In an alternate embodiment, only a partial thickness of the plies 96 that comprise the band 64 may be split to accommodate assembly of the nozzle 100 or 105. In an embodiment, the one or more projections 102 and the one or more recesses 104 are each formed about a complete or partial perimeter of the recess sidewall 88 in the band 64, the vane 62 and/or the cavity wrap 78, respectively. In an alternate embodiment, the interlocking features may include a plurality of individually formed projections 102 and cooperative recesses 104 formed about a complete or partial perimeter of the recess sidewall 88, the vane 62 and/or the cavity wrap 78, respectively.

Monolithic ceramics, such as SiC are typically brittle materials. The stress strain curve for such a material is generally a straight line that terminates when the sample fractures. The failure stress is often dictated by the presence of flaws and failure occurs by rapid crack growth from a critical flaw. The abrupt failure is sometimes referred to as brittle or catastrophic failure. While the strength and failure strain of the ceramic are flaw dependent, it is not uncommon for failure strains to be on the order of ~0.1%.

Generally, CMC materials include a high strength ceramic type fiber, such as Hi-Nicalon™ Type S manufactured by COI Ceramics, Inc. The fiber is embedded in a ceramic type matrix, such as SiC or SiC that contains residual free silicon. In the example of a SiC—SiC composite, where SiC fiber reinforces a SiC matrix, an interface coating such as Boron Nitride is typically applied to the fiber. This coating allows the fiber to debond from the matrix and slide in the vicinity of a matrix crack. A stress-strain curve for the fast fracture of a SiC—SiC composite generally has an initial linear elastic portion where the stress and strain are proportional to each other. As the load is increased, eventually the matrix will crack. In a well-made composite, the crack will be bridged by the reinforcing fiber. As the load on the composite is further increased, additional matrix cracks will form, and these cracks will also be bridged by the fibers. As the matrix cracks, it sheds load to the fibers and the stress strain curve becomes non-linear. The onset of non-linear stress-strain behavior is commonly referred to as the proportional limit or the matrix cracking stress. The bridging fibers impart toughness to the composite as they debond from the matrix and slide in the vicinity of the matrix cracks. At the location of a through crack, the fibers carry the entire load that is applied to the composite. Eventually, the load is great enough that the fibers fail, which leads to composite failure. The ability of the CMC to carry load after matrix cracking is often referred to as graceful failure. The damage tolerance exhibited by CMCs makes them desirable over monolithic ceramics that fail catastrophically.

CMC materials are orthotropic to at least some degree, i.e. the material's tensile strength in the direction parallel to the length of the fibers (the fiber direction, or 0 degree direction) is stronger than the tensile strength in the perpendicular directions (the 90 degree or the interlaminar/through thickness direction). Physical properties such as modulus and Poisson's ratio also differ with respect to fiber orientation. Most composites have fibers oriented in multiple directions. For example, in the prepreg MI SiC—SiSiC CMC, the architecture is comprised of layers, or plies, of unidirectional fibers. A common architecture consists of alternating layers of 0 and 90 degree fibers, which imparts toughness in all directions in the plane of the fibers. This ply level architecture does not, however, have fibers that run in the through thickness or interlaminar direction. Consequently, the strength and toughness of this composite is lower in the interlaminar direction than in the in-plane directions.

CMCs exhibit tough behavior and graceful failure when matrix cracks are bridged by fibers. Of greatest concern herein is failure of the joints that are formed when the CMC material components forming the portion of the nozzle 34 are joined together, in response to an applied load. If any of the joints are loaded in a direction such that they can fail and separate without breaking fibers, then there is the potential for brittle, catastrophic failure of that joint. Alternatively, if any of the joints are loaded in a direction such that, after matrix cracking in the joint, fibers bridge the crack, then there is the potential for tough, damage tolerant, graceful failure of the joint.

Figure 8:
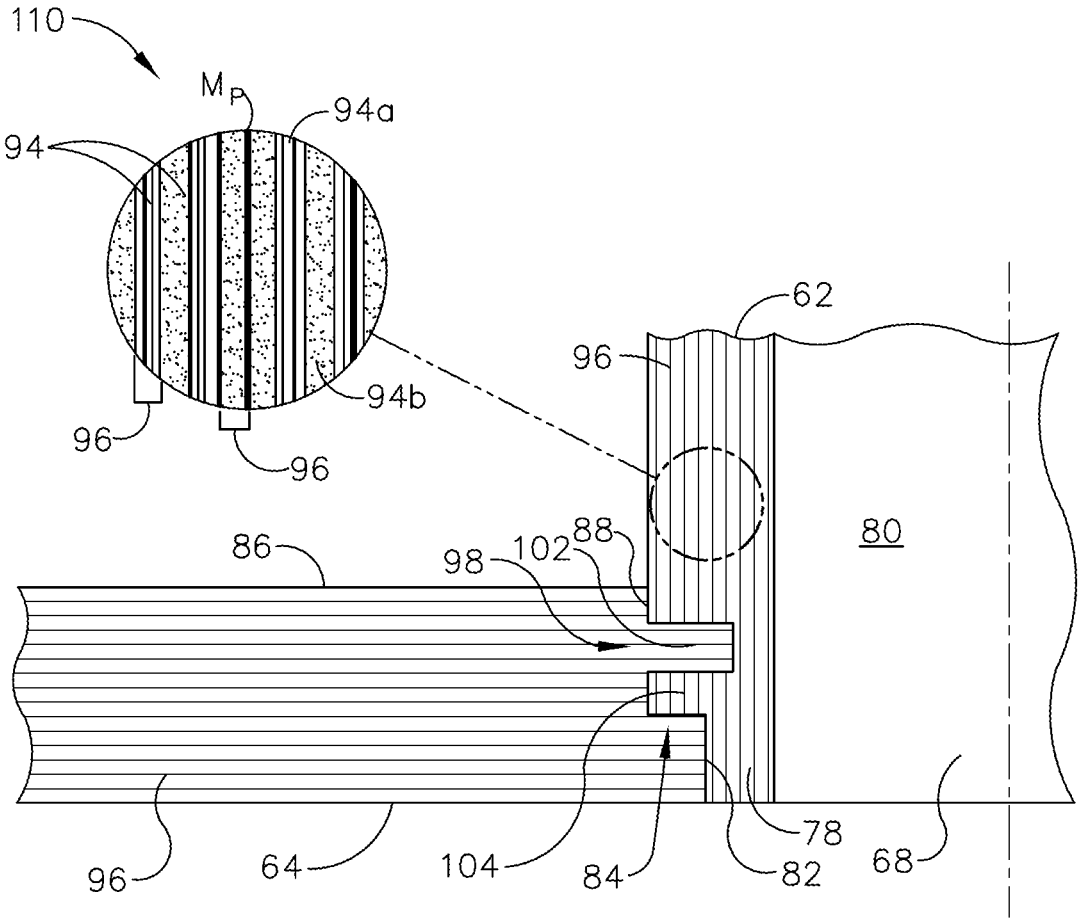
FIG. 8 is a simplified cross-section view illustrating another embodiment of an interlocking mechanical joint for joining a plurality of subcomponents of a nozzle, in accordance with one or more embodiments shown or described herein.

Referring now to FIG. 8, illustrated in simplified sectional view is an alternate embodiment of an interlocking mechanical joint 98 for joining the vane 62 and the band 64 to form a larger component structure, and more particularly a nozzle, generally referenced 110. It should be noted that in the embodiments illustrating and describing the interlocking mechanical joints that only a portion of the interlocking joint that is formed about the cavity wrap 78 and opening 82 in the band 64 is illustrated. In the embodiment of FIG. 8, as previously noted, illustrated is the vane 62 being joined thereto the band 64 at the interlocking mechanical joint 98. In the illustrated embodiment, the vane 62 and the band 64 are formed of a ceramic matrix composite (CMC) including reinforcing fibers embedded in a matrix. In an alternate embodiment, either the vane 62 or the band 64 are formed as a ceramic monolithic subcomponent. As best illustrated in FIG. 8, the vane 62 and the band 64 are illustrated joined one to the other at the interlocking mechanical joint 98. In this particular embodiment, interlocking mechanical joint 98 is configured as a typical woodworking mortise and tenon-type joint. More particularly, the vane 62 and band 64 are configured wherein a projection 102 of the band 64 engages with a recess 104 formed in the vane 62. In an alternate embodiment, the recess 104 is formed in the cavity wrap 78 in the manner of FIG. 7B. In an embodiment, the projection 102 and recess 104 are each formed about a complete or partial perimeter of the recess sidewall 88, the vane 62 and/or the cavity wrap 78, respectively. In an alternate embodiment, the interlocking features may include a plurality of individually formed projections 102 and cooperative recesses 104 formed about a complete or partial perimeter of the recess sidewall 88, the vane 62 and/or the cavity wrap 78, respectively.

As previously described with regard to the nozzle 100 of FIGS. 5-7B, during assembly of the nozzle 110, the plies 96 that comprise the band 64 are split, such as along lines 106 (FIG. 6) to enable positioning of the vane 62 relative to the band 64 and engagement of the cooperative interlocking features 102 and 104 that form the interlocking mechanical joint 98. In an embodiment, the full thickness of plies 96 that comprise the band 64 may be split to accommodate assembly of the nozzle 110. In an alternate embodiment, only a partial thickness of the plies 96 that comprise the band 64 may be split to accommodate assembly of the nozzle 110.

As illustrated in the blown-out enlargement of FIG. 8, in the embodiments disclosed herein, each of the components that form the nozzle subcomponents disclosed herein, including the vane 62, the band 64 and any additional interlocking components (described presently), are comprised of a plurality of fibers 94 forming the plies 96 oriented in the plane of the respective component so as to provide improved interlocking of the joint and minimize joint failure. In the embodiment of FIG. 8, as illustrated the plurality of fibers 94 extend from top to bottom in a layer 94*a* and into and out of the paper in a layer 94*b*. In the illustrated embodiment, the architecture of the plies 96 is symmetric about a mid-plane of the component. Maintaining symmetry of the component plies 96 helps to minimize any distortion or stresses that may arise due to any differences between 0-degree and 90-degree plies. The illustrated 8-ply panel is illustrated having a typical architecture (0/90/0/90:90/0/90/0), which is symmetric about the mid-plane $M_p$. In an alternate embodiment, the plies 96 are not symmetric about the mid-plane $M_p$. In yet another alternate embodiment, the architecture includes plies 96 oriented in a direction other than 0 or 90 degrees, such as +/−45 degrees, some other angle, or a combination of various angles. In an embodiment, the expected loading direction would require the vane 62 or band 64 to pull away from one another (in the vertical direction as oriented in the figures). In an embodiment, the plurality of plies 96 forming the vane 62 and the band 64 are not connected by fibers as none of the fibers bridge the joint 98. The fibers 94 in the projection 102 of the band 64 are interlocked with the fibers 94 in the vane 62 and thus would need to break in order for the vane 62 or the band 64 to be separated from one another. In this manner, the joint has toughness in the loading direction.

Figure 9:
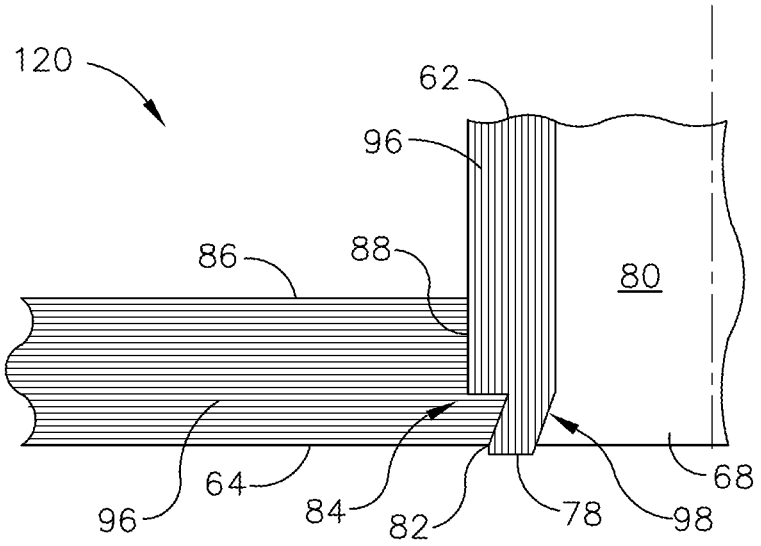
FIG. 9 is a simplified cross-section view illustrating another embodiment of an interlocking mechanical joint for joining a plurality of subcomponents of a nozzle, in accordance with one or more embodiments shown or described herein.
Figure 10:
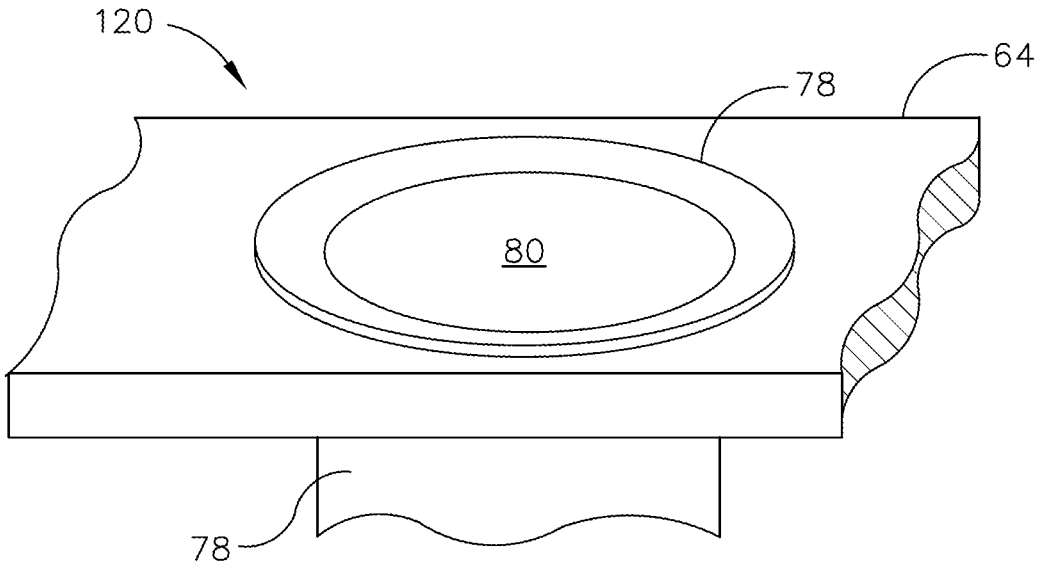
FIG. 10 is a schematic perspective view of an underneath side of the band subcomponent of FIG. 9, in accordance with one or more embodiments shown or described herein.

Referring now to FIGS. 9-12, illustrated in simplified sectional and perspective views are embodiments of an interlocking mechanical joint, for joining the vane 62 and the band 64 to form a larger component structure, and more particularly a nozzle, generally referenced 120, 130, respectively. More specifically, as illustrated in FIGS. 9 and 10, illustrated is an embodiment of a nozzle 120 including an interlocking mechanical joint 98. Similar to the previous embodiments illustrating and describing the interlocking mechanical joint, only a portion of the interlocking joint that is formed between the vane 62 and the band 64 is illustrated. In this particular embodiment, the at least one interlocking mechanical joint 98 is formed by a bend in the cavity wrap 78, and more particularly, by bending the cavity wrap 78 about the opening 82 formed in the band 64 to interlock the vane 62 and the band 64. In the embodiment of FIGS. 9 and 10, as previously noted, illustrated is the vane 62 being joined thereto the band 64 at an interlocking mechanical joint 98. In the illustrated embodiment, the vane 62 and the band 64 are formed of a ceramic matrix composite (CMC) including reinforcing fibers embedded in a matrix. In an alternate embodiment, either the vane 62 or the band 64 are formed as a ceramic monolithic subcomponent. As previously stated, the interlocking mechanical joint 98 is formed by bending at least a portion of the cavity wrap 78 relative to the band 64 to prevent movement between the vane 62 and the band 64. FIG. 10 illustrates the cavity wrap 78 extending through the band 64. In an alternate embodiment, the cavity wrap 78 may be buried in a layer of the band 64, whereby plies of the band 64 are formed on top of the interlocking feature 98.

Figure 11:
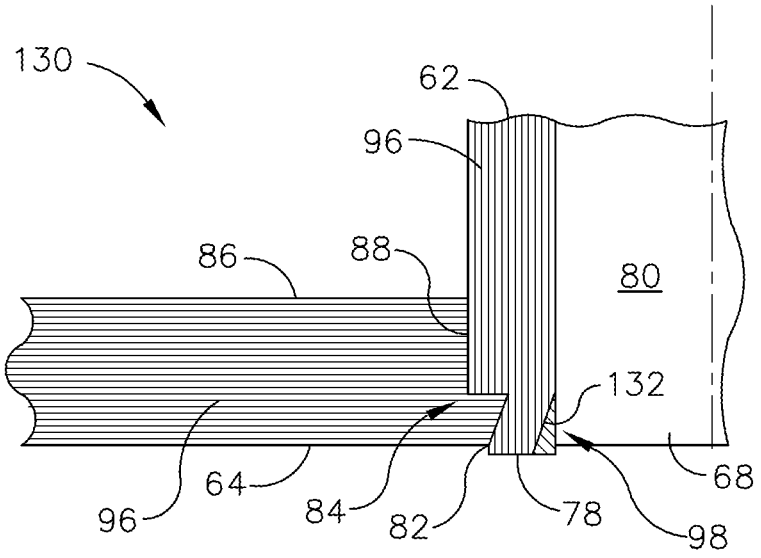
FIG. 11 is a simplified schematic view illustrating another embodiment of an interlocking mechanical joint for joining a plurality of subcomponents of a nozzle, in accordance with one or more embodiments shown or described herein.
Figure 12:
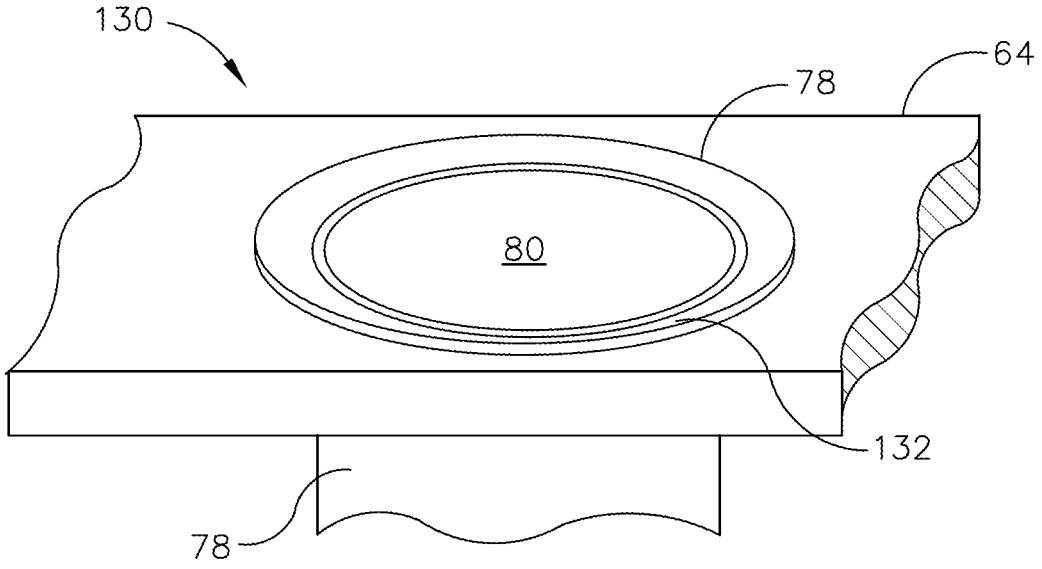
FIG. 12 is a schematic perspective view of an underneath side of the band subcomponent of FIG. 11, in accordance with one or more embodiments shown or described herein.

In yet another alternate embodiment of a nozzle, generally referenced 130, as best illustrated in FIGS. 11 and 12, after the cavity wrap 78 is bent in a manner to engage the vane 62 within the opening 82 in the band 64 as described with reference to FIGS. 9 and 10, an additional interlocking feature, and more particularly an interlocking insert 132 is positioned to further interlock the vane 62 relative to the band 64.

As previously described with regard to the nozzle 100 of FIGS. 5-7B, during assembly of the nozzle 120, 130 wherein the cavity wrap 78 is pre-configured to include a bend prior to assembly, and more particularly "pre-flared", the plies 96 that comprise the band 64 may be split, such as along lines 106 (FIG. 6) to enable positioning of the vane 62 relative to the band 64 and engagement to form the interlocking mechanical joint 98. In an alternate embodiment, if the cavity wrap 78 is bent subsequent to positioning of the vane 62 relative to the band 64, the plies 96 need not be split to accommodate assembly of the nozzle 120, 130. In yet another alternate embodiment, the plies 96 that comprise the vane 62 may be split to accommodate the contour of the cavity opening 82, regardless of assembly order.

Figure 13:
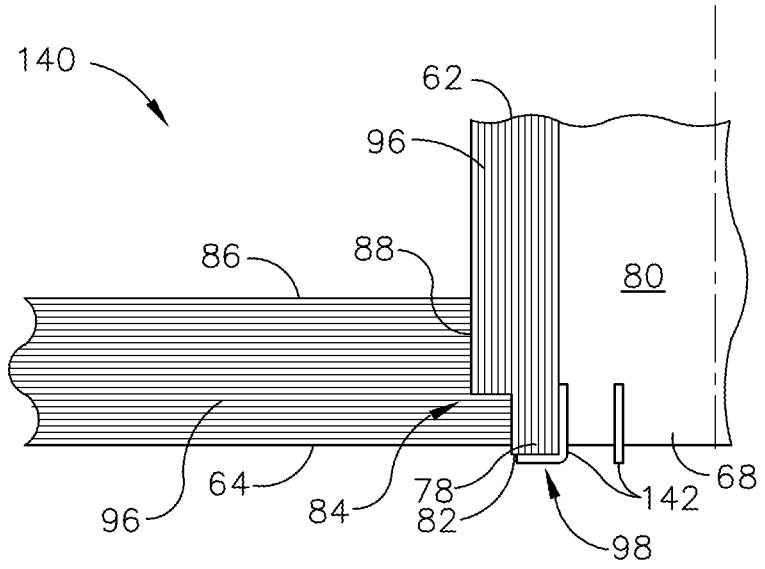
FIG. 13 is a simplified schematic view illustrating another embodiment of an interlocking mechanical joint for joining a plurality of subcomponents of a nozzle, in accordance with one or more embodiments shown or described herein.
Figure 14:
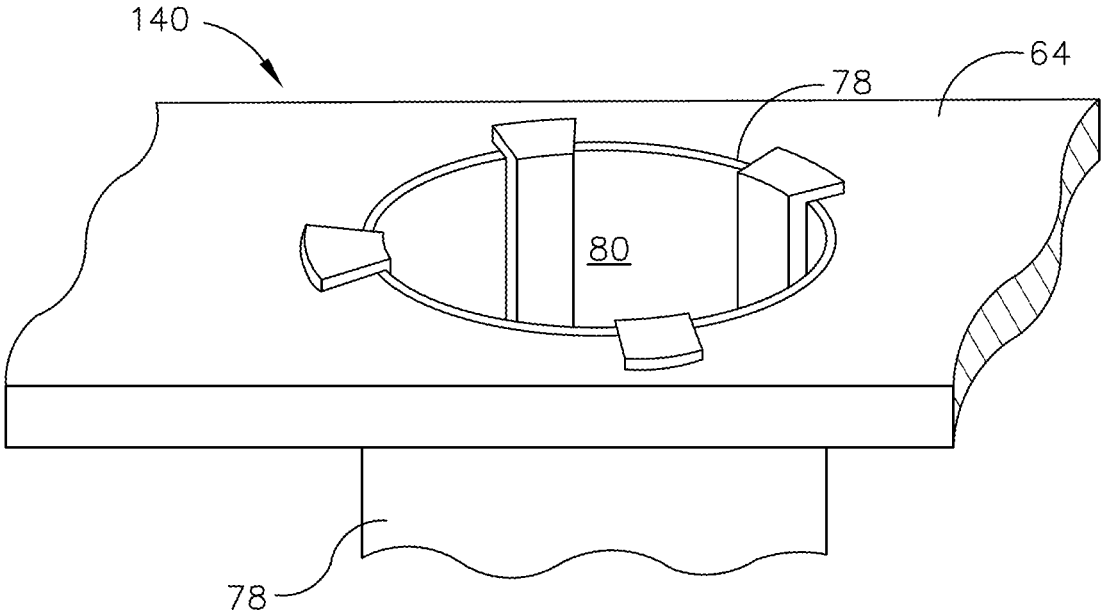
FIG. 14 is a schematic perspective view of an underneath side of the band subcomponent of FIG. 13, in accordance with one or more embodiments shown or described herein.

Referring now to FIGS. 13 and 14, illustrated in simplified sectional and perspective views is another embodiment of an interlocking mechanical joint 98, for joining the vane 62 and the band 64 to form a larger component structure, and more particularly a nozzle, generally referenced 140. More specifically, illustrated is an embodiment of a nozzle 140 including an interlocking mechanical joint 98. Similar to the previous embodiments illustrating and describing the interlocking mechanical joint, only a portion of the interlocking joint 98 that is formed between the vane 62 and the band 64 is illustrated. In this particular embodiment, the at least one interlocking mechanical joint 98 is formed by an additional interlocking feature, and more specifically by an additional interlocking subcomponent, and namely one or more strappings 142, also referred to as stirrups. As illustrated, the strappings 142 are positioned about an interior of the cavity wrap 78 and anchor the vane 62 relative to the band 64 about the opening 82 formed in the band 64 to interlock the vane 62 and the band 64. In the illustrated embodiment, the vane 62, the band 64 and the plurality of strappings 142 are formed of a ceramic matrix composite (CMC) including reinforcing fibers embedded in a matrix. In an alternate embodiment, any of the vane 62, the band 64 and/or the plurality of strappings 142 are formed as a ceramic monolithic subcomponent. The plurality of strappings 142 provide interlocking of the vane 62 and the band 64 and prevent movement between the vane 62 and the band 64.

FIG. 14 illustrates the plurality of strappings 142 coupled to the cavity wrap 78 and the band 64 about the opening 82 formed in the band 64. Similar to the embodiment of FIG. 5, as a result, a plurality of fibers (similar to fibers 94 previously described with regard to FIG. 8) forming the vane 62 and the band 64 are oriented at substantially right angles relative to one another. In this particular embodiment, the vane 62 and the band 64 are not connected by fibers as none of the fibers bridge the interlocking mechanical joint 98.

Figure 15:
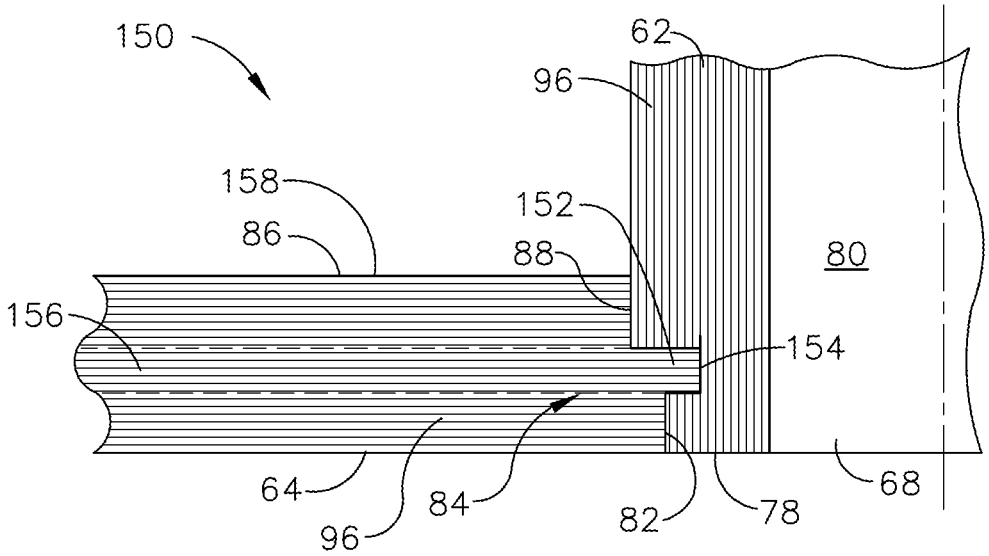
FIG. 15 is a simplified schematic view illustrating another embodiment of an interlocking mechanical joint for joining a plurality of subcomponents of a nozzle, in accordance with one or more embodiments shown or described herein.
Figure 16:
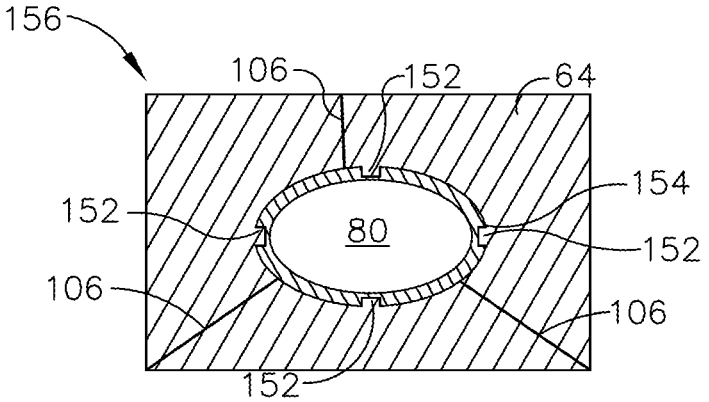
FIG. 16 is a schematic cross-sectional view of a portion of the band subcomponent of FIG. 15, in accordance with one or more embodiments shown or described herein.
Figure 17:
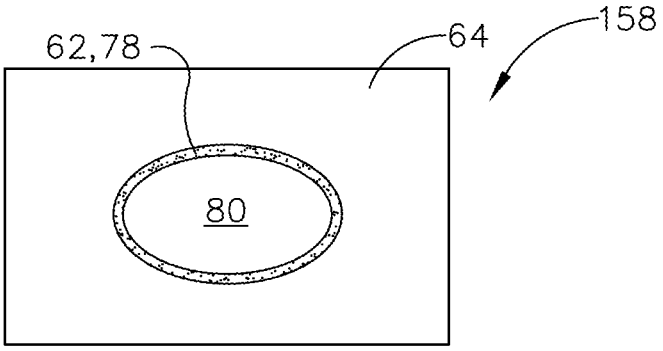
FIG. 17 is a schematic top view of a portion of the band subcomponent of FIG. 15, in accordance with one or more embodiments shown or described herein.

Referring now to FIGS. 15-17, illustrated is an alternate embodiment of an interlocking mechanical joint 98 for joining the vane 62 and the band 64 to form a larger component structure, and more particularly a nozzle, generally referenced 150. FIG. 15 is a simplified sectional view of a portion of the vane 62 coupled to the band 64. FIG. 16 is a cross-sectional view taken through a tabbed layer (described presently) of the band 54 and FIG. 17 is a top view looking at the outer surface 86 of the band 64 and vane 62. In this particular embodiment, the interlocking mechanical joint 98 includes at least one interlocking feature, and more particularly, a plurality of tabs 152 formed integral with an intermediate tabbed layer 156 of the band 64 and extending about the opening 82 in a manner so as to cooperatively engage with a plurality of recesses 154 formed in the vane 62. In an alternate embodiment, the tabs 152 may be configured to extend fully through the vane 62, cooperatively engaging with a recess 154 formed therethrough the vane 62. The tabs 152 include fixed or non-fixed insertion therein the recesses 154, so that the tabs 152 extend at least partially through the vane 62. It should be noted that in an embodiment, the recesses 154 may be formed in the cavity wrap 78. Similar to the previously disclosed embodiments, as a result, a plurality of fibers (similar to fibers 94 previously described with regard to FIG. 8) forming the band 64 are oriented at substantially right angles to a plurality of fibers forming the vane 62. In this embodiment, the vane 62 and the band 64 are not connected by fibers as none of the fibers bridge the interlocking mechanical joint 98.

As best illustrated in FIG. 16, during assembly of the nozzle 150, at least a portion of the plies 96 that comprise the band 64 are split, such as along lines 106 to enable positioning of the vane 62 relative to the band 64 and engagement of the cooperative interlocking features, and more specifically the tabs 152 and recesses 104 that form the interlocking mechanical joint 98. In an embodiment, the full thickness of plies 96 that comprise the band 64 may be split to accommodate assembly of the nozzle 150. In an alternate embodiment, such as illustrated in FIGS. 16 and 17, only a partial thickness of the plies that comprise the band 64, generally referenced 156, and more particularly the plies 96 having formed therein the tabs 152, may be split to accommodate assembly of the nozzle 150, while subsequent plies, generally referenced 158 do not require splitting, as best illustrated in FIG. 17. In an embodiment, the interlocking features includes a plurality of individually formed tabs 152 and cooperative recesses 154 formed about a complete perimeter of the recess sidewall 88 and the vane 62, respectively. In an alternate embodiment, the interlocking features includes a plurality of individually formed tabs 152 and cooperative recesses 154 formed about only a portion of the perimeter of the recess sidewall 88 and the vane 62, respectively. It should additionally be noted, that while only four tabs 152 and cooperative recesses 154 are illustrated, any number of tabs and cooperative recesses may be included.

Figure 18:
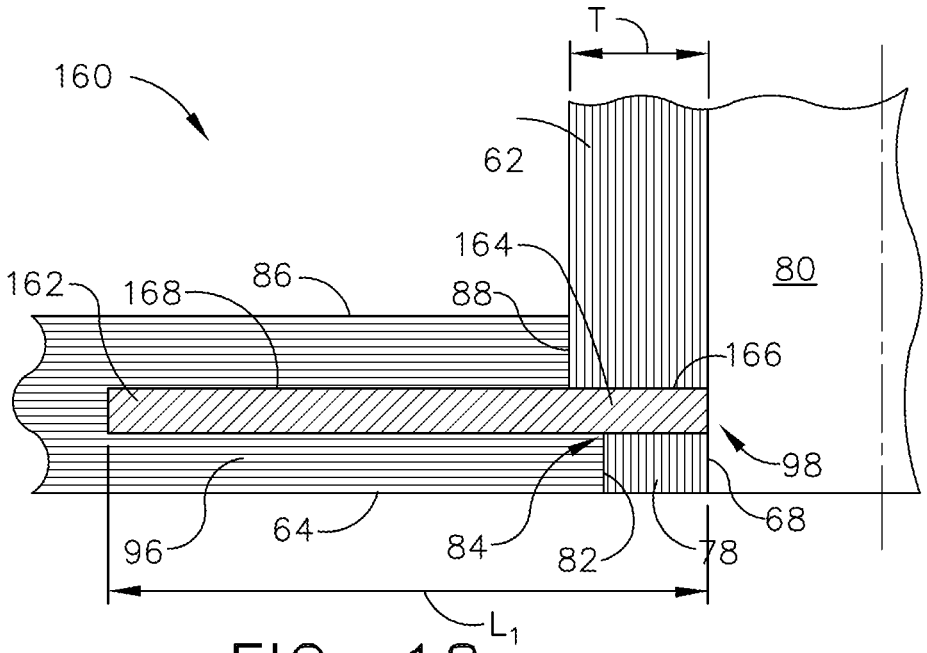
FIG. 18 is a simplified schematic view illustrating another embodiment of an interlocking mechanical joint for joining a plurality of subcomponents of a nozzle, in accordance with one or more embodiments shown or described herein.
Figure 19:
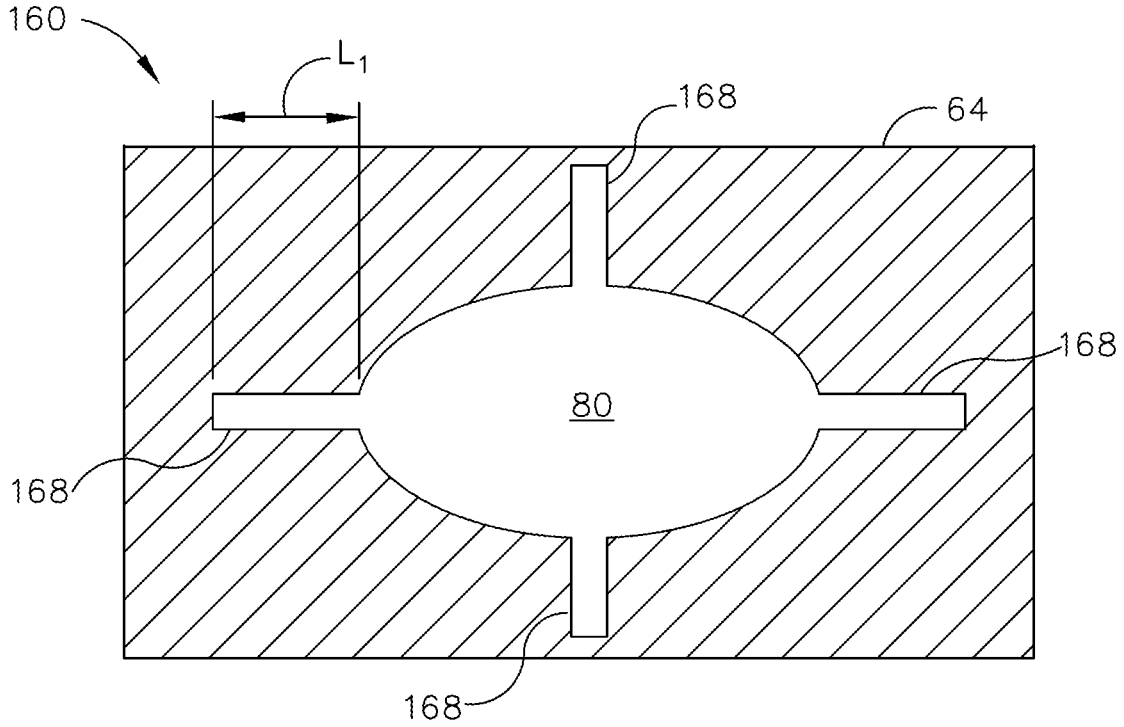
FIG. 19 is schematic cross-sectional view of a portion of the band subcomponent of FIG. 18, in accordance with one or more embodiments shown or described herein.
Figure 20:
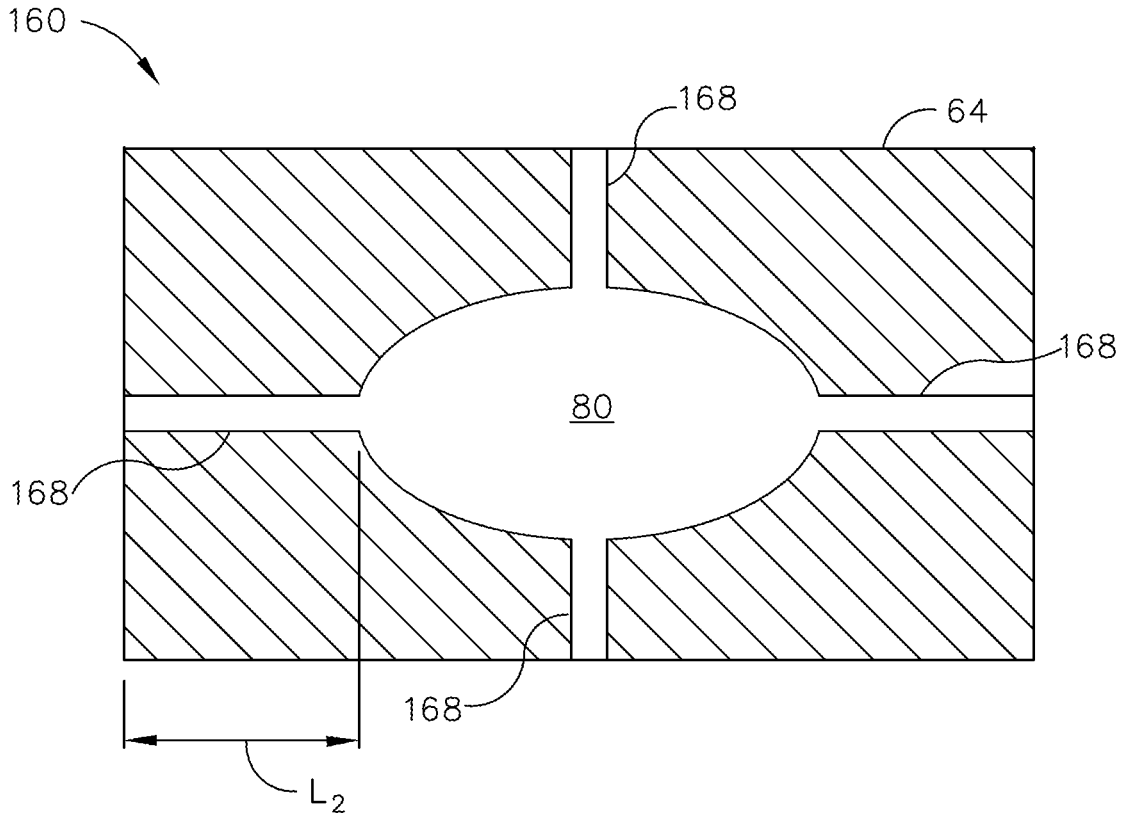
FIG. 20 is schematic cross-sectional view illustrating another embodiment of a portion of the band subcomponent, in accordance with one or more embodiments shown or described herein.
Figure 21:
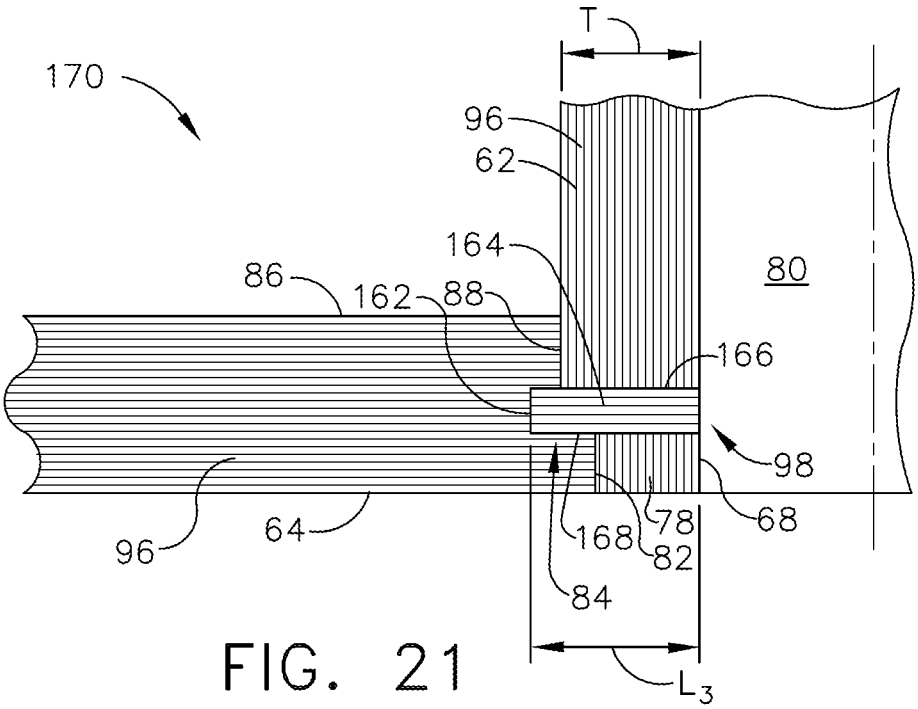
FIG. 21 is a simplified schematic view illustrating another embodiment of an interlocking mechanical joint for joining a plurality of subcomponents of a nozzle, in accordance with one or more embodiments shown or described herein.
Figure 22:
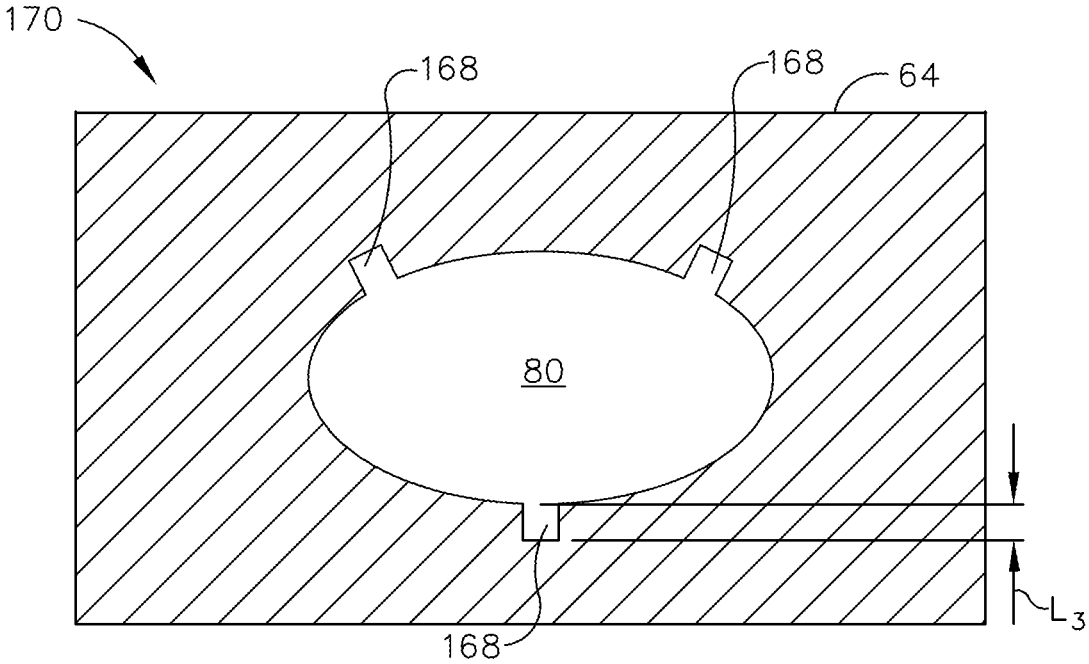
FIG. 22 is schematic cross-sectional view of a portion of the band subcomponent of FIG. 21, in accordance with one or more embodiments shown or described herein.

Referring now to FIGS. 18-22, illustrated are additional embodiments of an interlocking mechanical joint 98. More particularly, illustrated in FIG. 18 is a portion of a nozzle 160, generally similar to portion of the nozzle 34 of FIG. 1, including the interlocking mechanical joint 98, in a simplified sectional view. FIG. 19 is a top view illustrating an intermediate band layer of FIG. 18, and more particularly a plurality of receiving slots (described presently) formed in the band 64. FIG. 20 is a top view of an alternate embodiment of the intermediate band layer of FIG. 18, and more particularly a plurality of receiving slots (described presently) formed in the band 64. Similarly, illustrated in FIG. 21 is a portion of a nozzle 170, generally similar to portion of the nozzle 34 of FIG. 1, including the interlocking mechanical joint 98, in a simplified sectional view. FIG. 22 is a top view illustrating an intermediate band layer of FIG. 21, and more particularly a plurality of receiving slots (described presently) formed in the band 64.

In the embodiments of FIGS. 18-22, the interlocking mechanical joint 98 includes at least one additional interlocking subcomponent 162, comprising at least one interlocking CMC pin 164, also referred to as a biscuit, each disposed within one of a plurality of receiving slots 166 formed in the vane 62 and one of a plurality of receiving slots 168 formed in the band 64 in a manner so as to form the interlocking mechanical joint 98. The at least one interlocking CMC pin 164 is generally similar to a "biscuit" in the woodwork joinery field. In the embodiment of FIGS. 18 and 19, the interlocking CMC pin 164 extends a length "$L_1$" from a cavity surface 68 of the vane 62 into a substantial portion of the band 64. In the embodiment of FIG. 20, the plurality of receiving slots 166 formed in the vane 62 (not shown) and the plurality of receiving slots 168 formed in the band 64 extend a length "$L_2$" from a cavity surface 68 of the vane 62 through the complete band 64, wherein $L_1<L_2$, and thus making the interlocking CMC pin 164 for use in FIG. 20, longer than the interlocking CMC pin 164 of FIGS. 18 and 19. In addition, in the embodiment of FIG. 20, the interlocking CMC pin 164 (not shown) may be inserted from an exterior of the band 64. In the embodiment of FIGS. 21 and 22, the interlocking CMC pin 164 extends a length "$L_3$" from a cavity surface 68 of the vane 62, just into a portion of the band 64, wherein $L_3<L_2$, and thus making the interlocking CMC pin 164 of FIGS. 21 and 22 shorter than the interlocking CMC pin 164 of FIGS. 18, 19 and 20. In an embodiment, the plurality of receiving slots 166, 168 and the interlocking CMC pin 164 need not be configured with close tolerances when a matrix, such as glue, is utilized. In an alternate embodiment, the plurality of receiving slots 166, 168 and the interlocking CMC pin 164 are configured with close tolerances.

The interlocking CMC pin 164 provides a toughened or stronger joint between the vane 62 and the band 64. The toughened joint will have an increased ability to withstand applied forces exerted thereon the vane 62 and the band 64, as described herein. To provide for such interlocking CMC pin 164, the vane 62 has formed therein the receiving slot 166, extending across an interlaminar thickness "T" of the vane 62. In an alternate embodiment, the receiving slot 166 may extend across a partial interlaminar thickness of the vane 62. For positioning of the interlocking CMC pin 164 in a respective receiving slot 166, 168, the vane 62, and more particularly the cavity wrap 78, is positioned within the opening 82 formed in the band 64 prior to completion of the buildup of plies 96 of the band 64. The interlocking CMC pin 164 is inserted into the receiving slots 166 of the vane 62, with a sliding fit until the interlocking CMC pin 164 is engaged with the receiving slot 166 in the vane 62. Next, the intermediate layer of plies 96, illustrated in FIGS. 19 and 20, including the plurality of slots 168 formed during fabrication is positioned about the interlocking CMC pins 164. Subsequent plies 96 of the band 64 are then fabricated to complete fabrication of the band 64. In an alternate embodiment, the receiving slots 166 in the vane 62 and/or the receiving slots 168 in the band 64 may be formed subsequent to assembly of the nozzle subcomponents, by a machining operation, with the interlocking CMC pin 164 positioned relative thereto in a subsequent step. By machining the slots 166, 168, the band 64 would not require fabrication in multiple steps.

In the illustrated embodiments, each of the interlocking CMC pins 164 is configured having a substantially trapezoidal shape whereby an aspect ratio of the trapezoid provides greater shear load carrying capability than a simple round pin. In an alternate embodiment, the interlocking CMC pins may have any geometric shape, including but not limited to oval, round, rectangular, etc. One of the plurality of interlocking CMC pins 164 is disposed within each of the slots 166, 168 to engage the vane 62 and the band 64 in a manner so as to form the interlocking mechanical joint 98. Similar to the previous embodiments including the tabs 154 (FIGS. 15-17), the interlocking CMC pin 164 may include fixed or non-fixed insertion therein the receiving slots 166, 168. In addition, similar to the previous embodiments, as a result, a plurality of fibers (similar to fibers 94 previously described with regard to FIG. 8) forming the vane 62 and the band 64 are oriented at substantially right angles to one another. In addition, the plurality of fibers 94 forming the vane 62 and the fibers 94 forming the interlocking CMC pin 164 are oriented at substantially right angles to one another. In the embodiments of FIGS. 18-22, the vane 62, the band 64 and the interlocking CMC pin 164 are not connected by fibers as none of the fibers bridge the interlocking mechanical joint 98. In an alternative embodiment, the fibers are oriented in one direction (all at 0 degree or all at 90 degrees, depending on the reference angle). In an embodiment, the interlocking CMC pin 164 includes all of its fibers oriented uni-directionally (i.e. running left to right across the page). In the illustrated embodiment of FIGS. 18 and 19, four interlocking CMC pins 164 are illustrated and in the embodiment of FIGS. 21 and 22, three interlocking CMC pin 164 are illustrated. It should be understood that the interlocking mechanical joint 98 may comprise any number of interlocking CMC pins 164 and cooperative receiving slots 166, 168.

Figure 23:
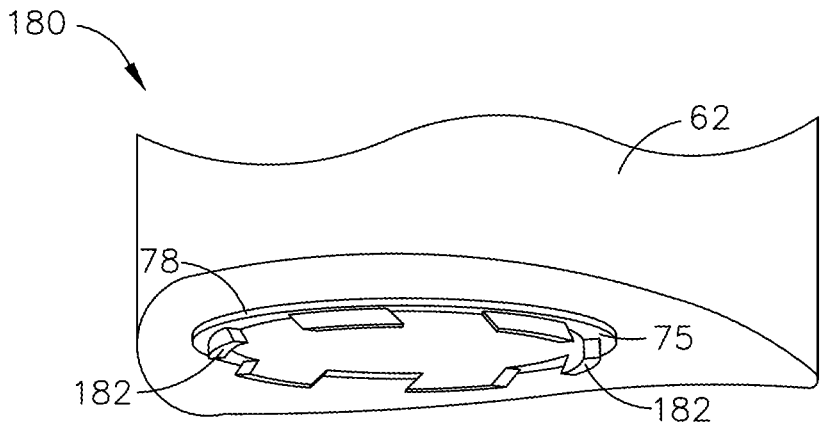
FIG. 23 is a schematic perspective view illustrating a vane configuration for forming an interlocking mechanical joint for joining a plurality of subcomponents of a nozzle, in accordance with one or more embodiments shown or described herein.
Figure 24:
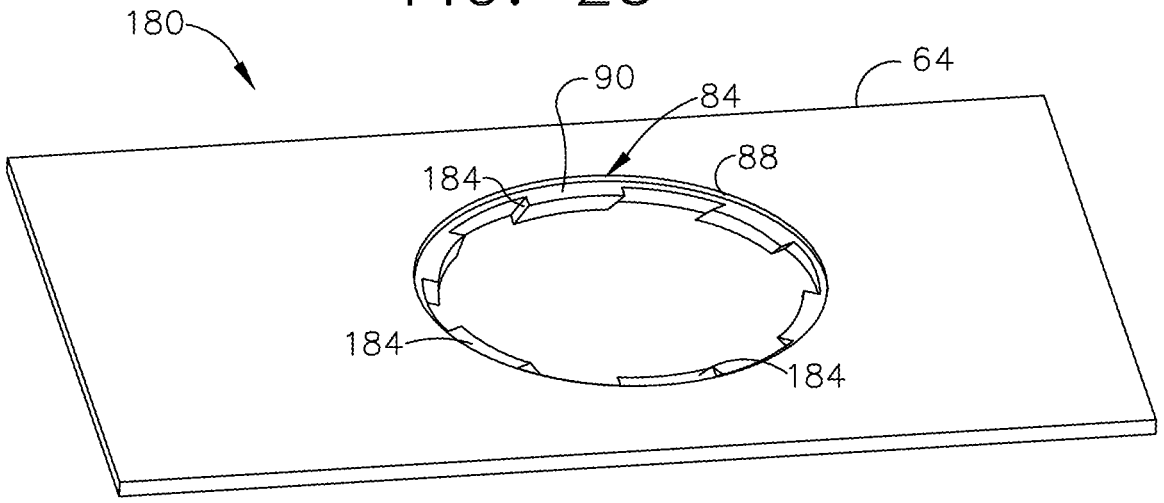
FIG. 24 is a schematic perspective view illustrating a band configuration for forming an interlocking mechanical joint for joining a plurality of subcomponents of a nozzle, in accordance with one or more embodiments shown or described herein.
Figure 25:
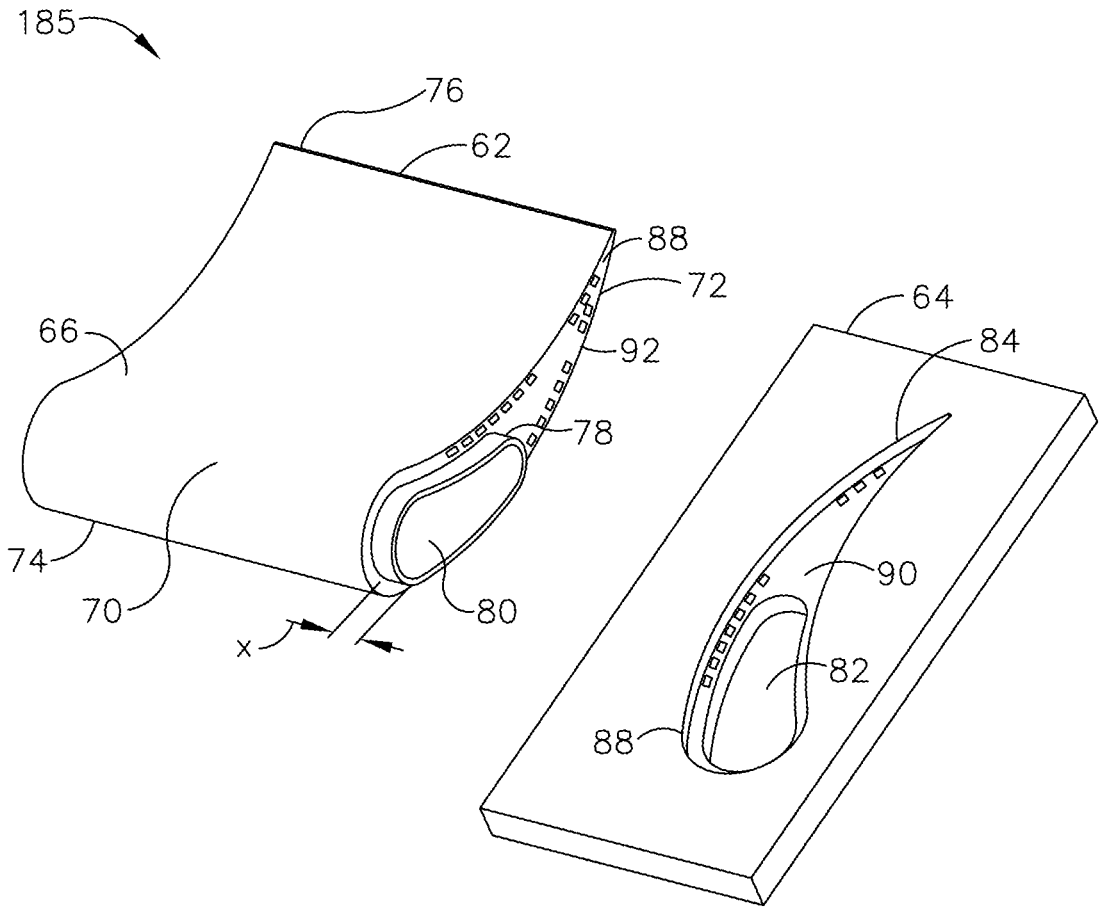
FIG. 25 is a schematic perspective view of a vane and band in an enjoined state, illustrating another embodiment of an interlocking mechanical, in accordance with one or more embodiments shown or described herein.

Referring now to FIGS. 23-25, illustrated in schematic views are portions of a vane 62 and a band 64, respectively, that form a portion of a nozzle component 180, 185 such as nozzle 34 of FIG. 1. As in the previous embodiments, the nozzle 180, 185 is comprised of the vane 62, the band 64 and at least one interlocking mechanical joint 98. As best illustrated in FIGS. 22 and 24, in this particular embodiment, the vane 62, and more specifically the cavity wrap 78, has defined therein a plurality of tooth-like structures 182 formed therein and along a longitudinally extending lower edge 79. In addition, as best illustrated in FIG. 24, the band 64 includes a plurality of tooth-like structures 184 about the opening 80. In an alternate embodiment, as best illustrated in FIG. 25, the vane 62 has defined thereabout at least a portion of the perimeter 92 a plurality of tooth-like structures 182 extending from an end 93 of the vane 62. In addition, the band 64 includes a plurality of tooth-like structures 184 in the surface 90 of the recess 84 in a manner so as to engage with the tooth-like structures 182. In yet another alternate embodiment, the plurality of tooth-like structures 182 may be formed about both the perimeter 92 of the vane 62 and about the cavity wrap 78 with cooperative tooth-like structures 184 formed in the band 64.

The interlocking mechanical joint 98 is defined when the plurality of tooth-like structures 182 of the vane 62 are cooperatively engaged with the plurality of tooth-like structures 184 of the band 64. It is noted that at least one set of the plurality of tooth-like structures 182, 184 are configured geometrically so as to lock against the other of the plurality of tooth-like structures 182, 184.

Similar to the previous embodiments including the tabs 154 (FIGS. 15-17), the interlocking plurality of tooth-like structures 182, 184 may be fixed or non-fixed relative to one another. In addition, similar to the previous embodiments, as a result, a plurality of fibers (similar to fibers 94 previously described with regard to FIG. 8) forming the vane 62 and the band 64 are oriented at substantially right angles to one another. In the embodiment of FIGS. 23-25, the vane 62 and the band 64 are not connected by fibers as none of the fibers bridge the interlocking mechanical joint 98. In the illustrated embodiment of FIGS. 23 and 24 six interlocking tooth-like structures 182 of the vane 62 and six cooperative interlocking tooth-like structures 184 of the band 64 are illustrated. It should be understood that in alternate embodiments, the interlocking mechanical joint 98 may comprise any number of interlocking tooth-like structures 182, 184 for coupling of the vane 62 to the band 64. Additionally, in alternate embodiments, the interlocking mechanical joint 98 may comprise any number of interlocking tooth-like structures formed about a perimeter 92 (FIG. 2) of the vane 62, and in particular at the trailing edge 76 (FIG. 2).

Figure 26:
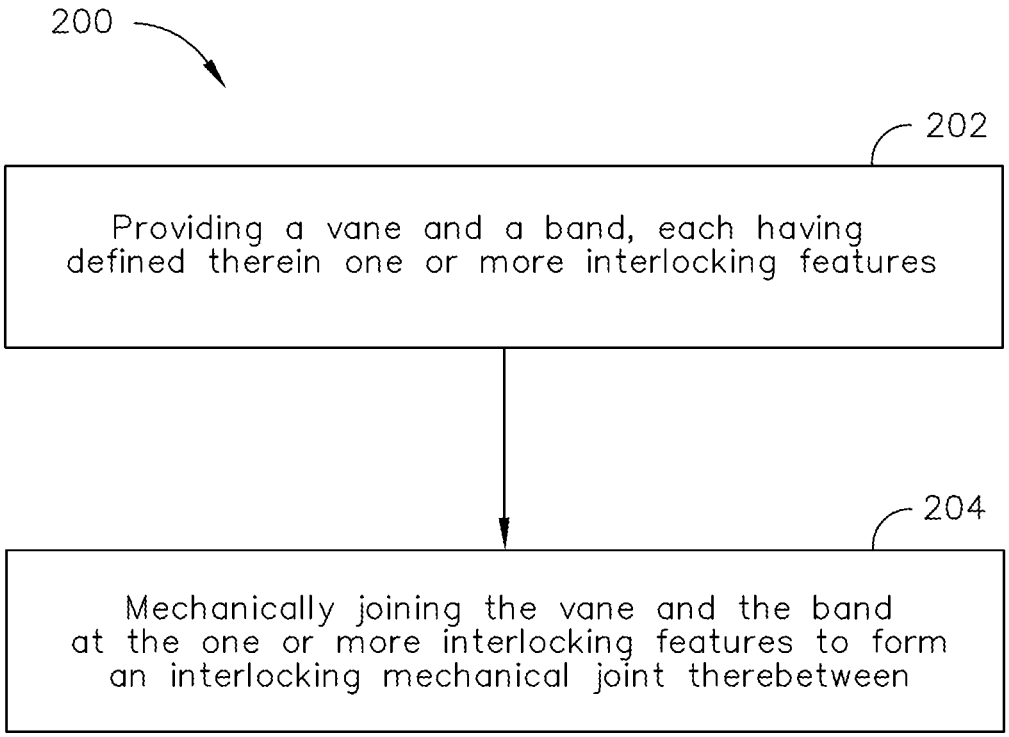
FIG. 26 illustrates a flowchart of a method for forming an interlocking mechanical joint for joining a plurality of subcomponents of a nozzle, in accordance with one or more embodiments shown or described herein.

FIG. 26 is a flowchart of a method 200 of forming a ceramic matrix composite (CMC) nozzle, in accordance with an embodiment disclosed herein. As shown in FIG. 24, the method 200 comprises providing a vane and a band comprised of a ceramic matrix composite (CMC) including reinforcing fibers embedded in a matrix, in a step 202.

Each of the vane and the band includes one or more interlocking features. In an embodiment, the at least one interlocking features may include one or more projections, recesses, tabs, and/or tooth-like structures. In an embodiment, the nozzle may further include one or more interlocking subcomponents, such as an insert, strappings, and/or interlocking CMC pins, as previously described. In an embodiment, the additional interlocking subcomponent is comprised of a ceramic matrix composite (CMC) including reinforcing fibers embedded in a matrix. As previously described, the plurality of reinforcing fibers are oriented along a length of the vane, the band and the additional interlocking subcomponent.

The vane and the band are next mechanically joined one to the other at an interlocking mechanical joint, in a step 204, to form the nozzle. The at least one interlocking mechanical joint may be comprised according to any of the previously described embodiments. The vane and the band are joined one to the other in a manner to orient the reinforcing fibers of the vane substantially orthogonal to the reinforcing fibers of the band. The interlocking mechanical joint is formed during a CMC manufacture process in one of an autoclave (AC) state, a burn out (BO) state, or melt infiltration (MI) state. In an embodiment, the interlocking mechanical joint may include direct bonding of the components together, or the components may be bonded by silicon, silicon carbide, a combination thereof, or other suitable material. The bonding material may be deposited as a matrix precursor material that is subsequently densified by MI, CVI, or PIP. Alternatively, the bonding material may be produced by MI, CVI, or PIP without the use of matrix precursor in the joint. As previously noted, the joints described herein may be formed at any appropriate stage in CMC processing. That is, the vane, the band, and/or an included interlocking subcomponent may be comprised of green prepreg, laminated preforms, pyrolyzed preforms, fully densified preforms, or combinations thereof.

Accordingly, described is the use of interlocking mechanical joints to join multiple subcomponents, and more specifically the use of interlocking mechanical joints, including one or more tabs, projections, recesses, tooth-like structures or reinforcing CMC pins, wherein the ceramic fibers that comprise the subcomponents or the interlocking means would need to be broken in order to separate the joint in an expected loading direction. While some existing interlocking mechanical joints behave in this manner, others do not and could fail by shearing the interlocking feature in the interlaminar direction. The interlocking mechanical joints as described herein provide for reinforcement of the subcomponents that make up the joint, without reinforcing the joint itself. This approach can greatly simplify the manufacturing process and prevent the property debits that can occur in a direction orthogonal to the reinforcement. The interlocking mechanical joining of the subcomponents as described herein can be done in the layed up state prior to lamination, in the autoclave (AC), burn out (BO), or melt infiltration (MI) state or combinations thereof of the CMC manufacture process. For joints made in the MI state, the joint may be left "unglued". These joints may also be easier to repair. In an embodiment, simple shapes, such as flat panels, can be green machined (in autoclaved state) and assembled using woodworking type interlocking mechanical joints as described herein. In an embodiment, a CMC matrix precursor slurry (or variants thereof) may be used to bond or glue the CMC subcomponents together. Final densification and bonding occurs in the MI state.

While the invention has been described in terms of one or more particular embodiments, it is apparent that other forms could be adopted by one skilled in the art. It is understood that in the method shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceramic matrix composite (CMC) component comprising:

a vane comprised of a ceramic matrix composite (CMC) including reinforcing fibers embedded in a matrix;

a band comprised of a ceramic matrix composite (CMC) including reinforcing fibers embedded in a matrix, the band including an interlocking recess comprising a recessed wall and a side wall, wherein the recessed wall forms a shape corresponding to a working surface of the vane, the side wall of the interlocking recess including an interlocking surface; and at least one interlocking mechanical joint joining the vane and the band to form the ceramic matrix composite (CMC) component, wherein the vane and the band directly interlock.

2. The component of claim 1, wherein the vane comprises a cavity wrap extending at least substantially through the vane and defining therein a cavity, the cavity wrap configured to engage with an opening in the band.

3. The component of claim 1, wherein the at least one interlocking joint comprises one or more projections defined in the band and cooperatively engaged with a respective one or more recesses formed in the vane, wherein at least a portion of an outer perimeter of the vane is retained within the interlocking recess by the band.

4. The component of claim 2, wherein the at least one interlocking joint comprises a bend in the cavity wrap cooperatively engaging the cavity wrap with the opening formed in the band.

5. The component of claim 4, further comprising an insert positioned proximate the bend in the cavity wrap.

6. The component of claim 2, wherein the at least one interlocking joint comprises one or more strappings coupling the vane to the band.

7. The component of claim 2, wherein the at least one interlocking joint comprises a plurality of tabs defined in the band and cooperatively engaged with a plurality of recesses formed in the vane.

8. The component of claim 2, wherein the at least one interlocking joint comprises at least one ceramic matrix composite (CMC) pin, each disposed in a slot in the band and cooperatively engaged with a slot formed in the vane.

9. The component of claim 2, wherein the at least one interlocking joint comprises a plurality of tooth-like structures formed in at least one of the cavity wrap and about a perimeter of the vane, the plurality of tooth-like structures of the vane cooperatively engaged with a plurality of tooth-like structures formed in the band.

10. The component of claim 3, wherein a suction side of the vane engages with a portion of the side wall of the interlocking recess of the band.

11. The component of claim 10, wherein said portion of the side wall is substantially contoured.

12. A nozzle for a gas turbine comprising:

a vane comprising a cavity wrap extending longitudinally through the vane and extending therefrom at least one end of the vane and defining therein a cavity, the vane comprised of a ceramic matrix composite (CMC) including reinforcing fibers embedded in a matrix;

a band including an interlocking recess comprising a recessed wall and a side wall, wherein the recessed wall forms a shape corresponding to a working surface of the vane, the side wall of the interlocking recess including an interlocking surface, the band comprised of a ceramic matrix composite (CMC) including reinforcing fibers embedded in a matrix; and at least one interlocking mechanical joint joining the vane and the band to form the nozzle, wherein the cavity wrap is configured to engage with the interlocking recess in the band at the at least one interlocking mechanical joint, wherein the vane and the band directly interlock.

13. The nozzle of claim 12, wherein the interlocking recess is configured to engage with at least a portion of an outer perimeter of the vane.

14. The nozzle of claim 12, wherein the at least one interlocking mechanical joint comprises one or more projections defined in the band and cooperatively engaged with a respective one or more recesses formed in the vane, wherein at least a portion of an outer perimeter of the vane is retained within the recess, by the band.

15. The nozzle of claim 12, wherein the at least one interlocking mechanical joint comprises a bend in the cavity wrap cooperatively engaging the cavity wrap with an opening formed in the band.

16. The nozzle of claim 15, further comprising an insert positioned proximate the bend in the cavity wrap.

17. The nozzle of claim 12, wherein the at least one interlocking mechanical joint comprises a plurality of tabs defined in the band cooperatively engaged with a plurality of slots formed in the vane.

18. The nozzle of claim 12, wherein the at least one interlocking mechanical joint comprises at least one ceramic matrix composite (CMC) pin, each disposed in a slot in the band and cooperatively engaged with a slot formed in the vane.

19. The nozzle of claim 12, wherein the at least one interlocking mechanical joint comprises a plurality of tooth-like structures formed in at least one of the cavity wrap or about a perimeter of the vane, the plurality of tooth-like structures of the vane cooperatively engaged with a plurality of tooth-like structures formed in the band.

20. A method of forming a ceramic matrix composite (CMC) component comprising:

providing a vane comprised of a ceramic matrix composite (CMC) including reinforcing fibers embedded in a matrix; and providing a band comprised of a ceramic matrix composite (CMC) including reinforcing fibers embedded in a matrix, the band including an interlocking recess comprising a recessed wall and a side wall, wherein the recessed wall forms a shape corresponding to a working surface of the vane, the side wall of the interlocking recess including an interlocking surface;

wherein each of the vane and the band include a plurality of interlocking features; and mechanically joining the vane to the band at the plurality of interlocking features to form at least one interlocking mechanical joint therebetween, wherein the vane and the band directly interlock.

21. The method of claim 20, wherein the at least one interlocking mechanical joint comprises at least one of:

one or more projections defined in the band and cooperatively engaged with a respective one or more recesses formed in the vane;

a bend in the vane cooperatively engaging a portion of the vane with an opening formed in the band;

one or more strappings coupling the vane to the band;

a plurality of tabs defined in the band cooperatively engaged with a plurality of slots formed in the vane;

at least one ceramic matrix composite (CMC) pin, each disposed in a slot in the band and cooperatively engaged with slot formed in the vane; and a plurality of tooth-like structures formed in the vane and cooperatively engaged with a plurality of tooth-like structures formed in the band.

* * * * *